US010008151B2

(12) United States Patent
Toyomura et al.

(10) Patent No.: US 10,008,151 B2
(45) Date of Patent: Jun. 26, 2018

(54) DISPLAY UNIT, DRIVE UNIT, DRIVING METHOD, AND ELECTRONIC APPARATUS

(71) Applicant: JOLED INC., Tokyo (JP)

(72) Inventors: Naobumi Toyomura, Kanagawa (JP); Tetsuro Yamamoto, Kanagawa (JP)

(73) Assignee: JOLED Inc., Tokyo (JP)

( * ) Notice: Subject to any disclaimer, the term of this patent is extended or adjusted under 35 U.S.C. 154(b) by 342 days.

(21) Appl. No.: 14/442,297

(22) PCT Filed: Dec. 18, 2013

(86) PCT No.: PCT/JP2013/083962
§ 371 (c)(1),
(2) Date: May 12, 2015

(87) PCT Pub. No.: WO2014/106929
PCT Pub. Date: Jul. 10, 2014

(65) Prior Publication Data

US 2015/0294623 A1 Oct. 15, 2015

(30) Foreign Application Priority Data

Jan. 7, 2013 (JP) ..... 2013-000473
Nov. 19, 2013 (JP) ..... 2013-239191

(51) Int. Cl.
*G09G 3/3258* (2016.01)
*G09G 3/3233* (2016.01)
(Continued)

(52) U.S. Cl.
CPC ..... *G09G 3/3258* (2013.01); *G09G 3/007* (2013.01); *G09G 3/3233* (2013.01); *G09G 3/3266* (2013.01); *G09G 3/3291* (2013.01); *G09G 2230/00* (2013.01); *G09G 2300/0408* (2013.01); *G09G 2300/0819* (2013.01);
(Continued)

(58) Field of Classification Search
None
See application file for complete search history.

(56) References Cited

U.S. PATENT DOCUMENTS

2005/0001830 A1 1/2005 Osame et al.
2005/0162354 A1* 7/2005 Osame ..... G09G 3/3233 345/76
(Continued)

FOREIGN PATENT DOCUMENTS

JP 2005-031598 A 2/2005
JP 2005-202372 A 7/2005
(Continued)

OTHER PUBLICATIONS

Japanese Office Action for JP2013-239191 dated Jul. 25, 2017.

*Primary Examiner* — Amare Mengistu
*Assistant Examiner* — Sarvesh J Nadkarni
(74) *Attorney, Agent, or Firm* — Michael Best & Friedrich LLP

(57) ABSTRACT

A display unit includes: a unit pixel; a switch configured to perform ON-OFF control between a second terminal and a third terminal, based on a pulse signal applied to a first terminal, the second terminal being supplied with a DC signal, and the third terminal being connected to the unit pixel; and a non-linear element interposed between the first terminal and the third terminal.

19 Claims, 23 Drawing Sheets

(51) Int. Cl.
*G09G 3/3266* (2016.01)
*G09G 3/00* (2006.01)
*G09G 3/3291* (2016.01)

(52) U.S. Cl.
CPC ..... *G09G 2300/0842* (2013.01); *G09G 2310/0272* (2013.01); *G09G 2310/0291* (2013.01); *G09G 2330/021* (2013.01)

(56) References Cited

U.S. PATENT DOCUMENTS

| | | | | |
|---|---|---|---|---|
| 2005/0162355 | A1* | 7/2005 | Yamazaki ..... | G09G 3/3241 345/76 |
| 2008/0252574 | A1 | 10/2008 | Sakai et al. | |

FOREIGN PATENT DOCUMENTS

| | | | |
|---|---|---|---|
| JP | 2005-242323 | A | 9/2005 |
| JP | 2008-268263 | A | 11/2008 |
| JP | 2009-223092 | A | 10/2009 |

* cited by examiner

[ FIG. 1 ]
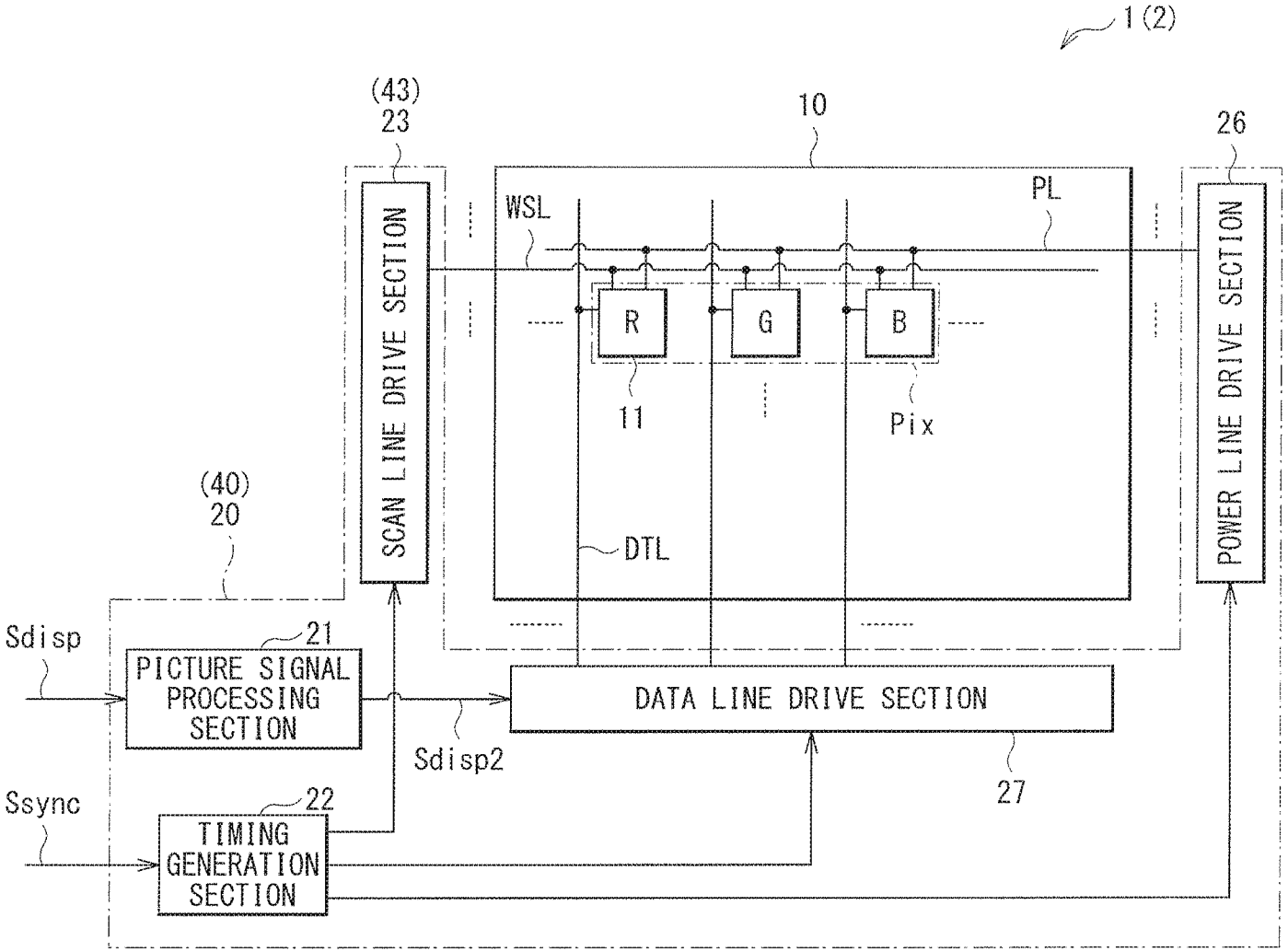

[ FIG. 2 ]
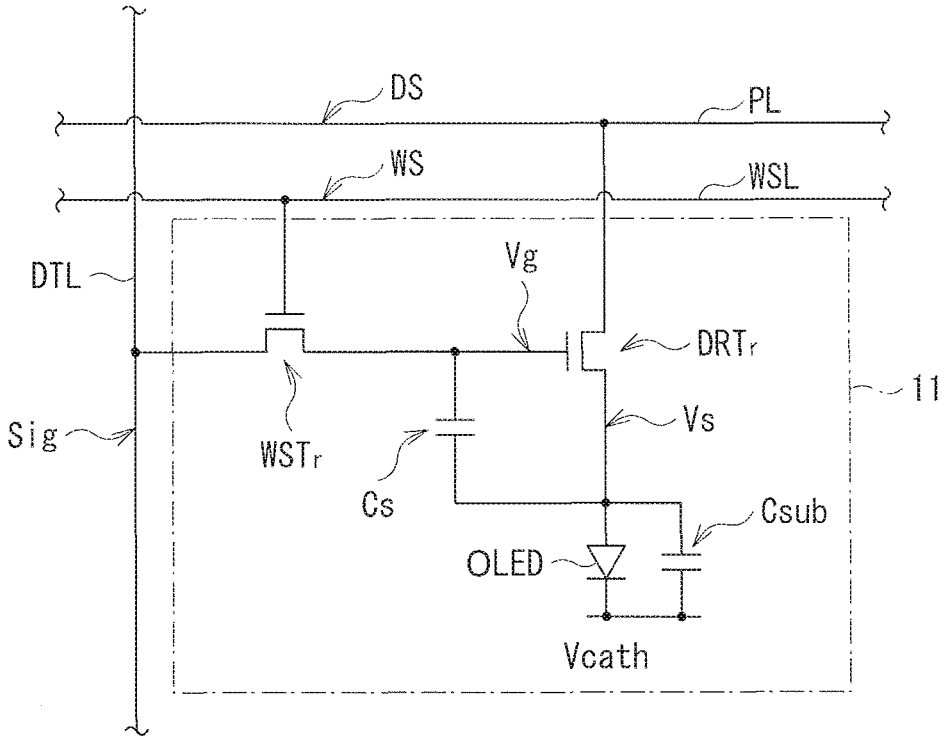

[ FIG. 3 ]
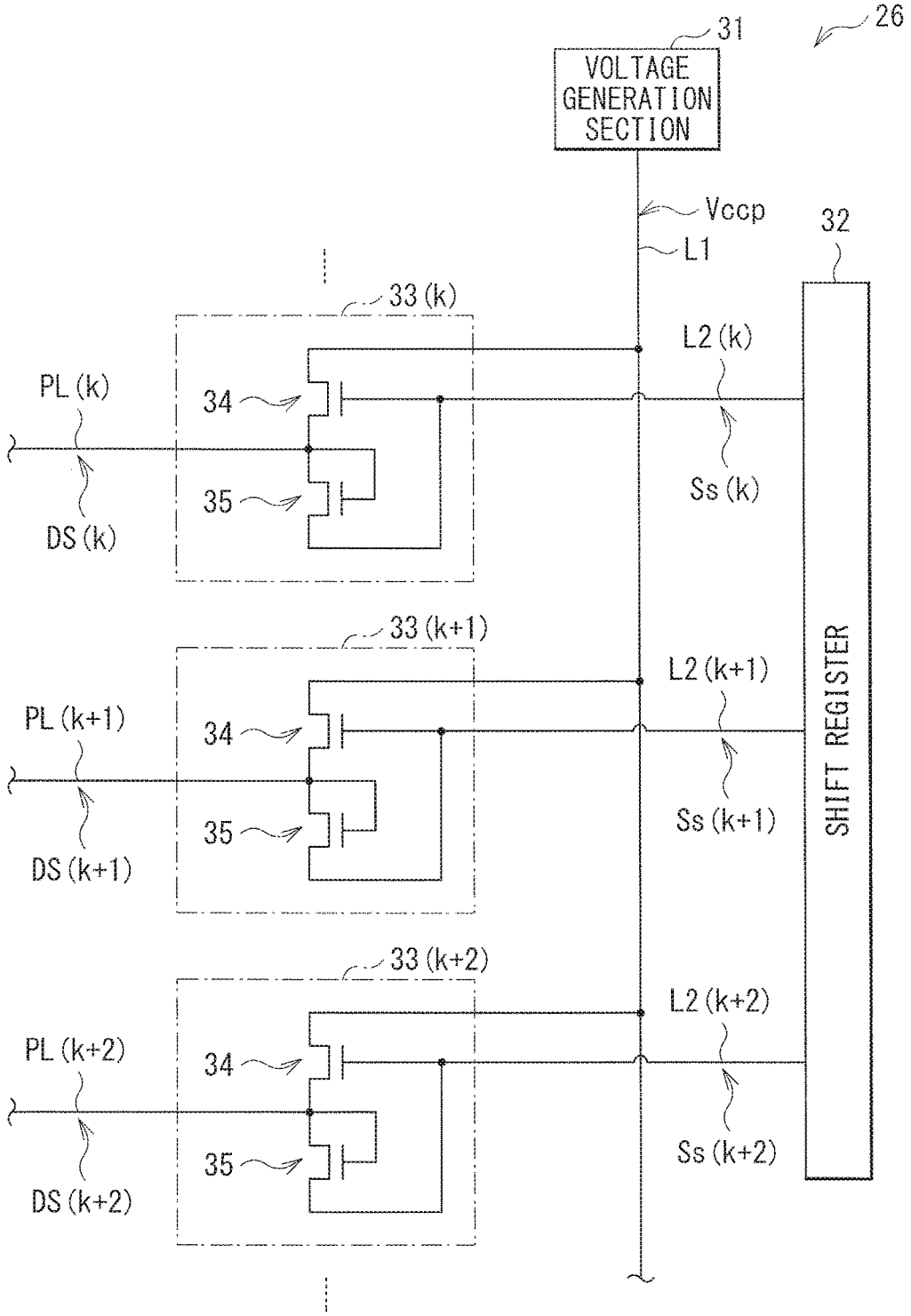

[ FIG. 4 ]
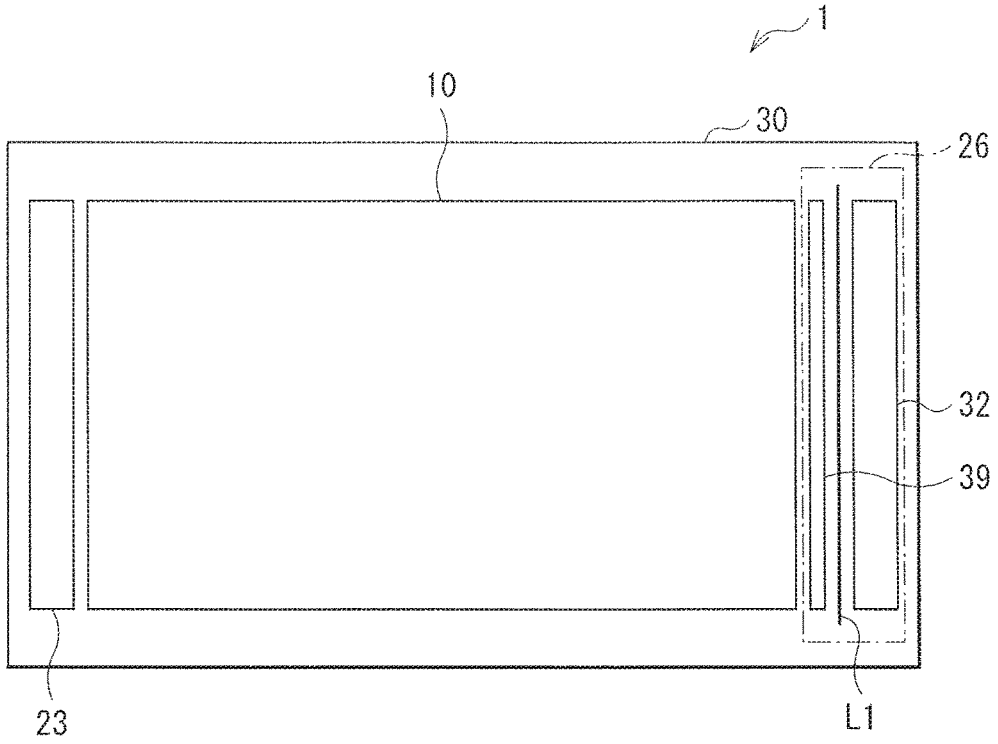

[ FIG. 5 ]
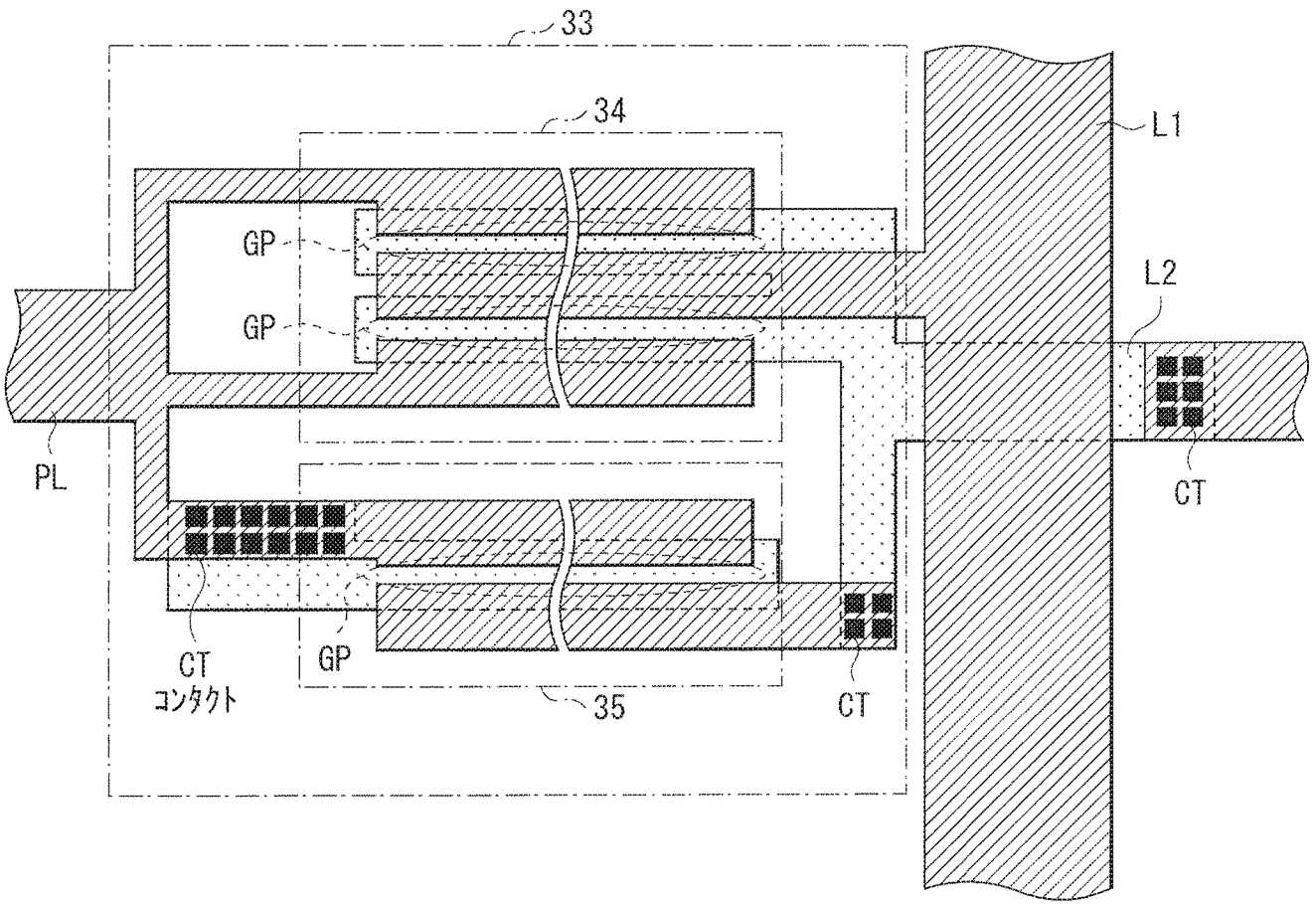

[ FIG. 6 ]
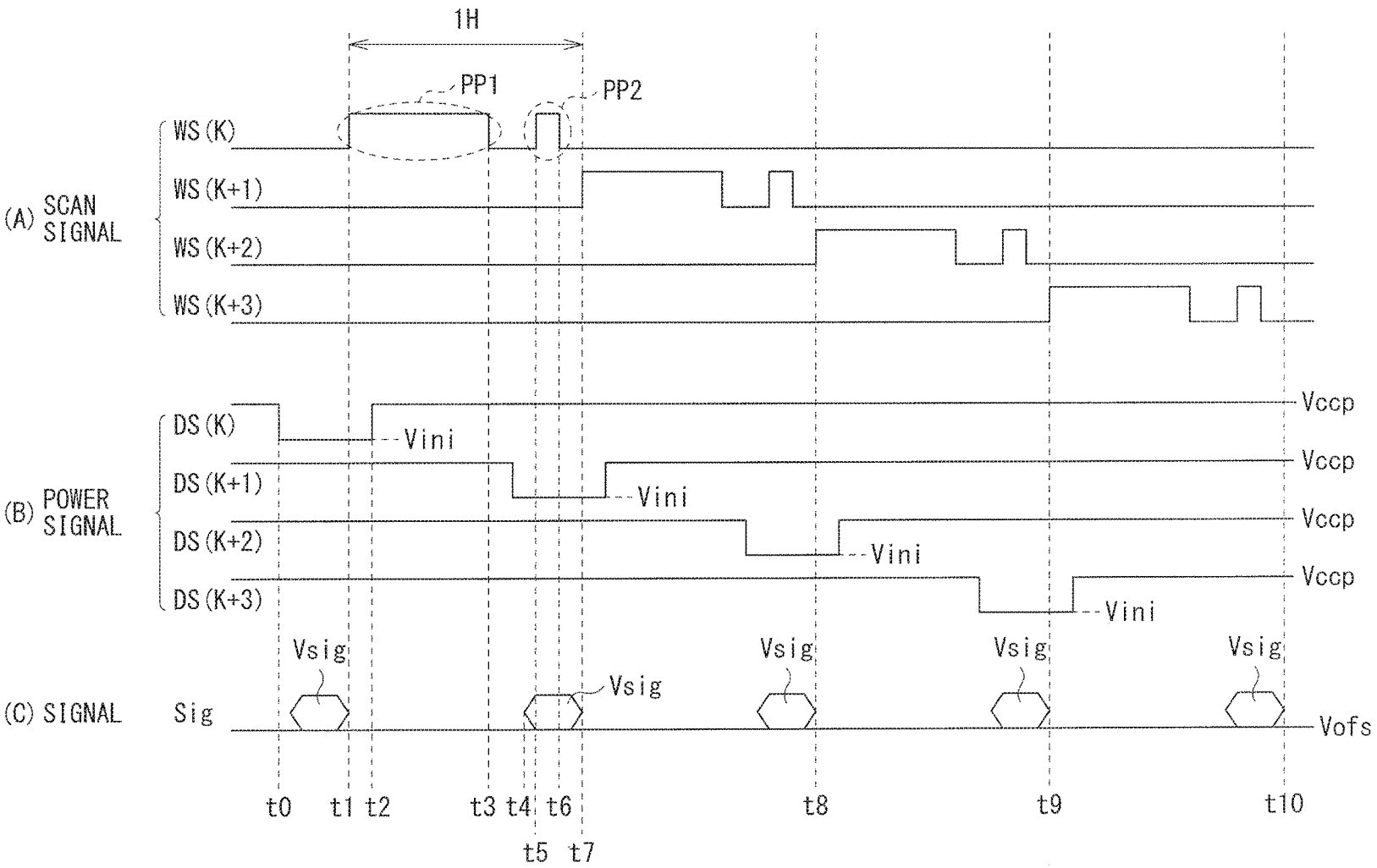

[ FIG. 7 ]
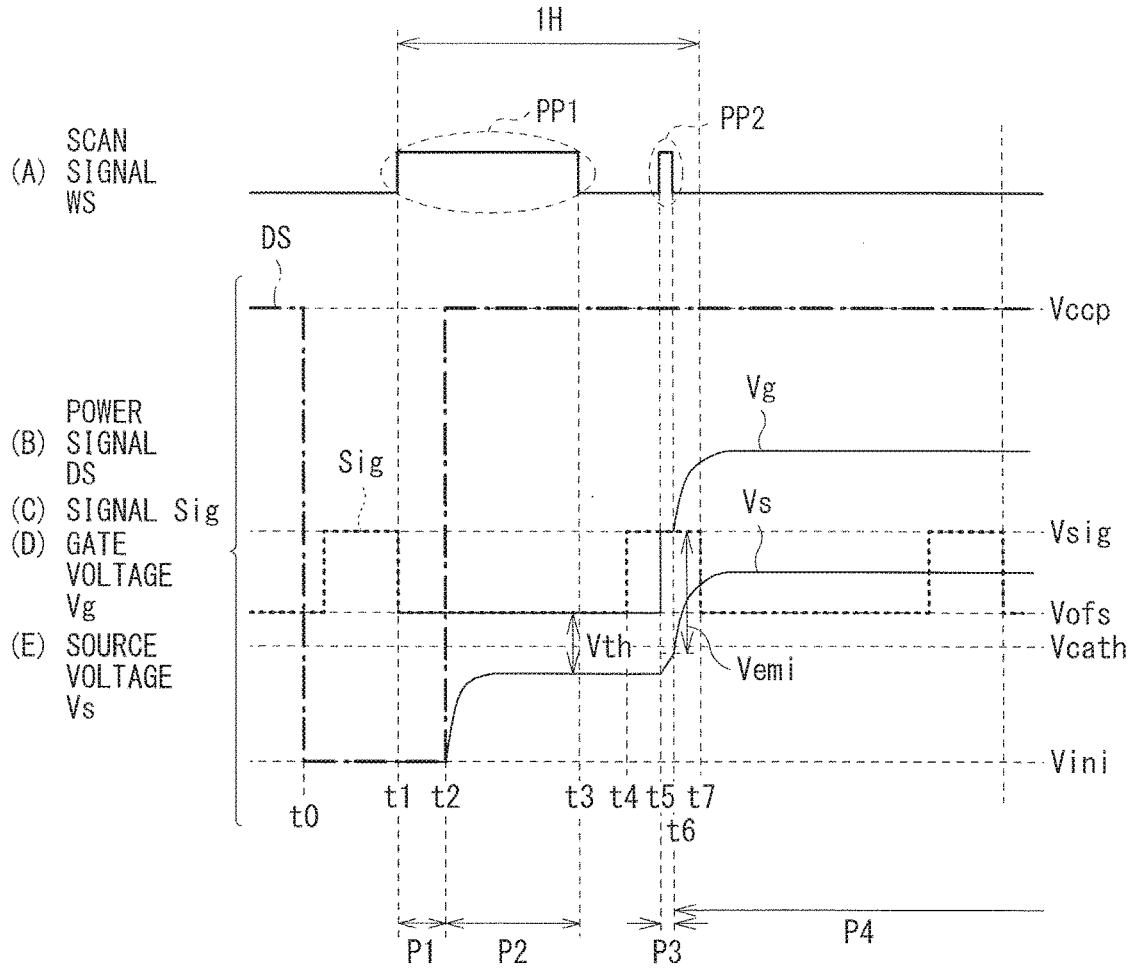

[ FIG. 8 ]
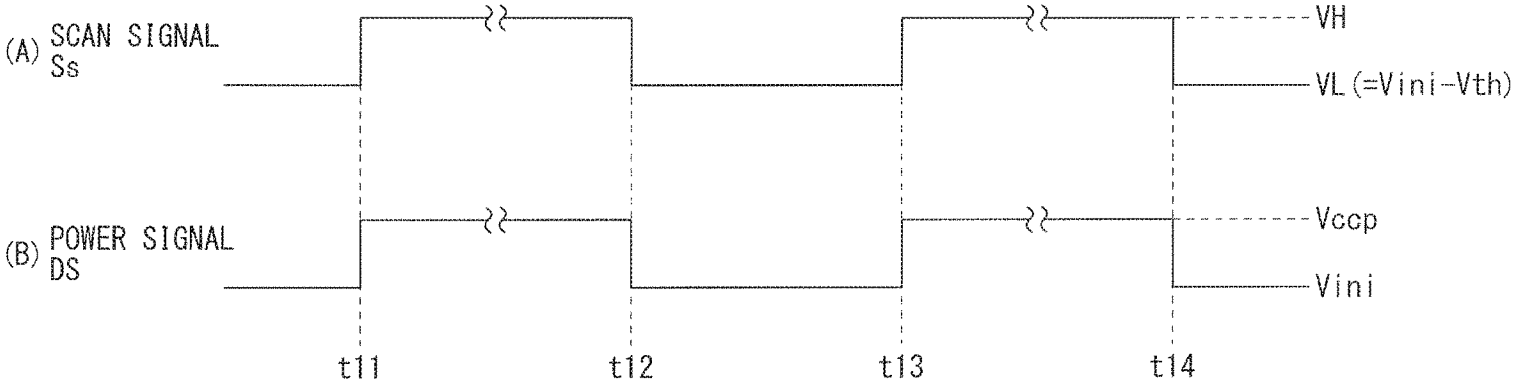

[ FIG. 9 ]
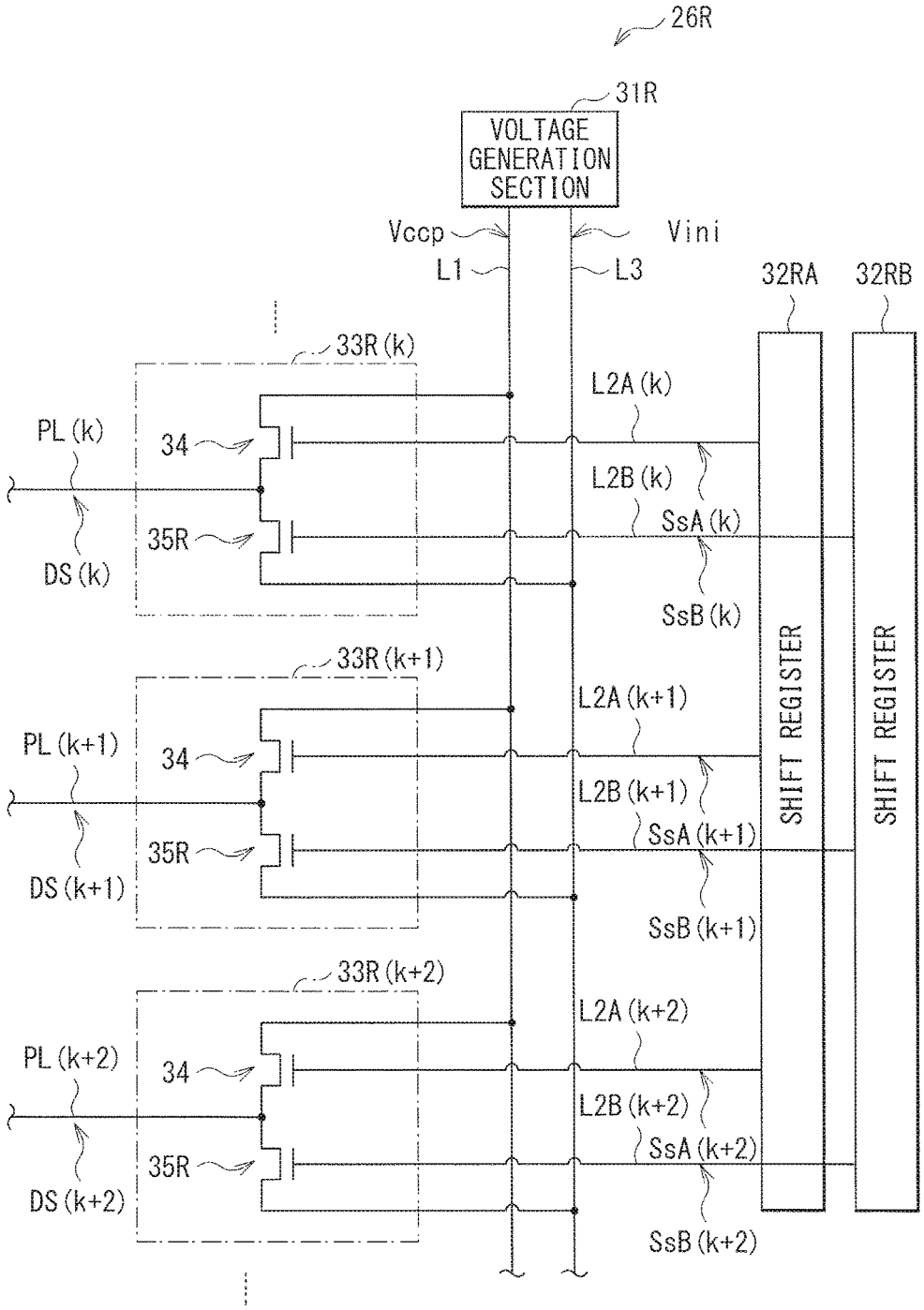

[ FIG. 10 ]
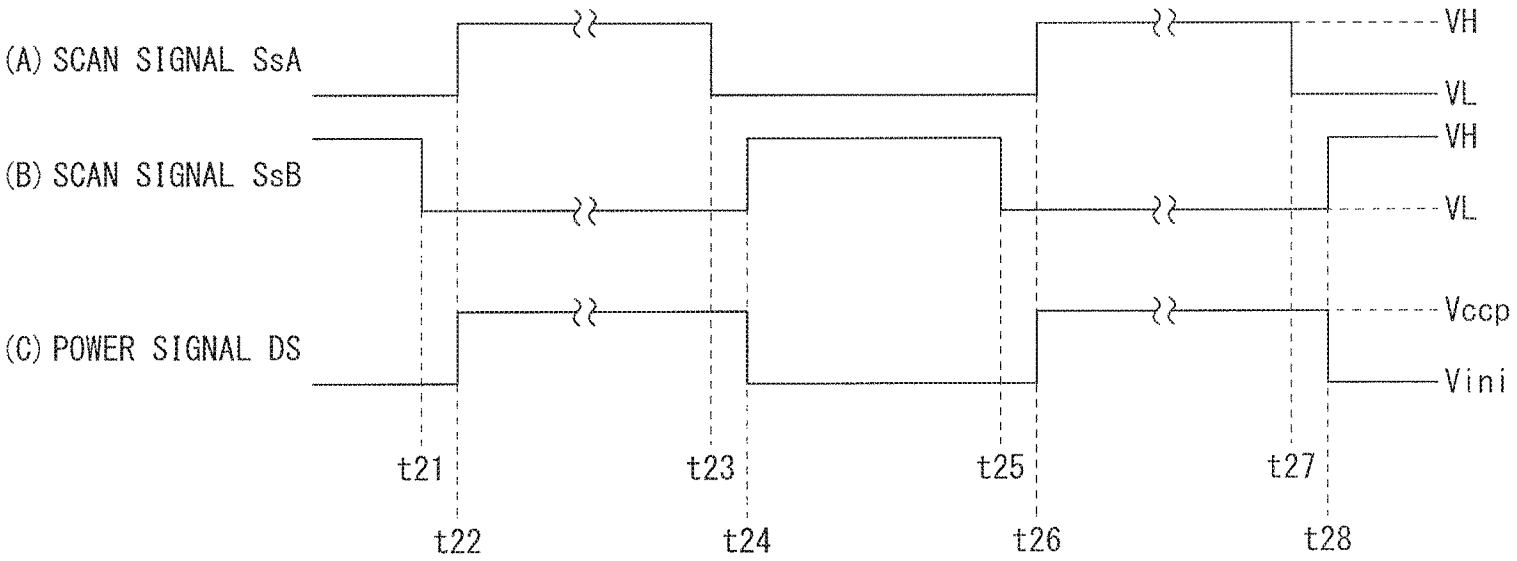

[ FIG. 11 ]
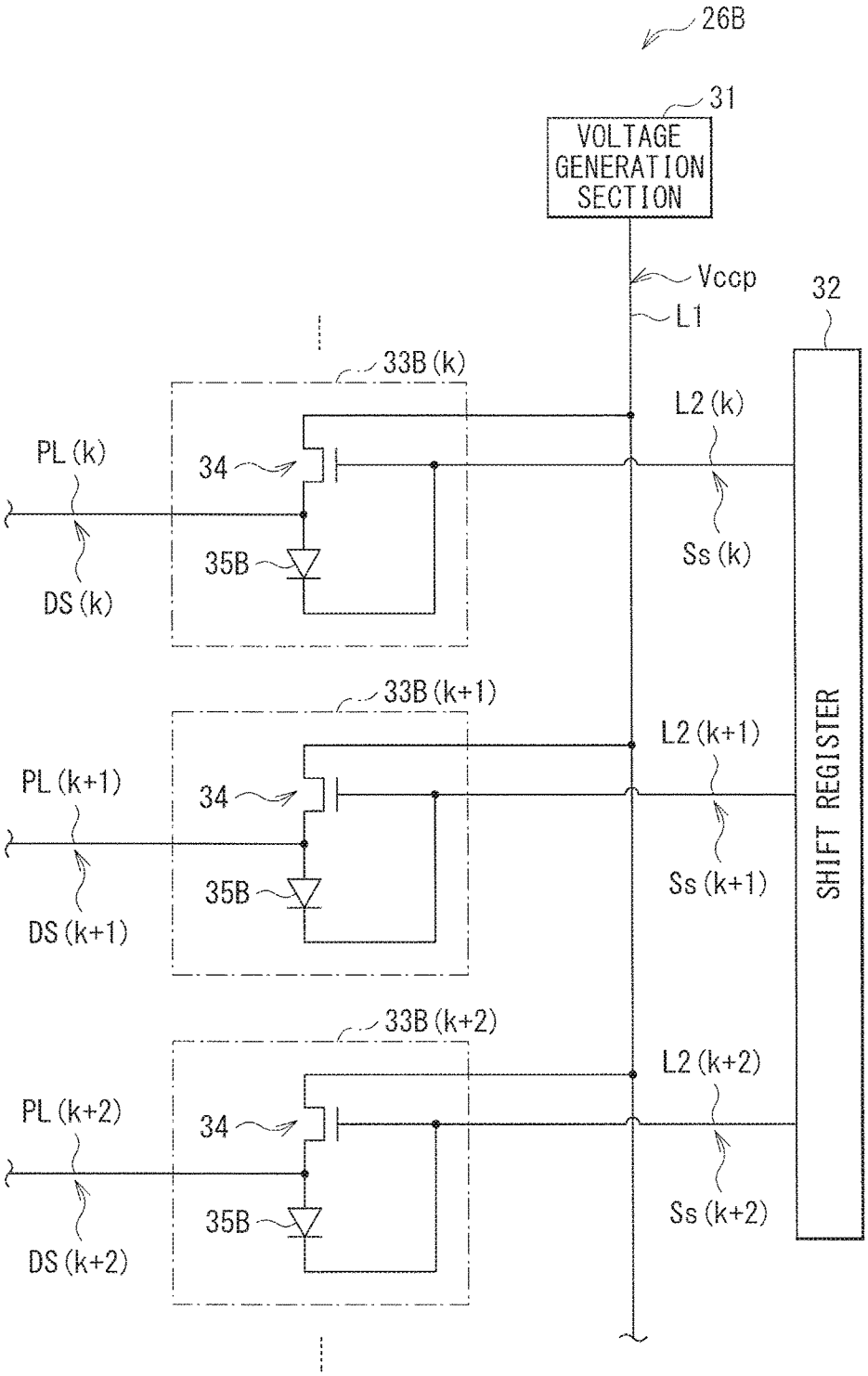

[ FIG. 12 ]
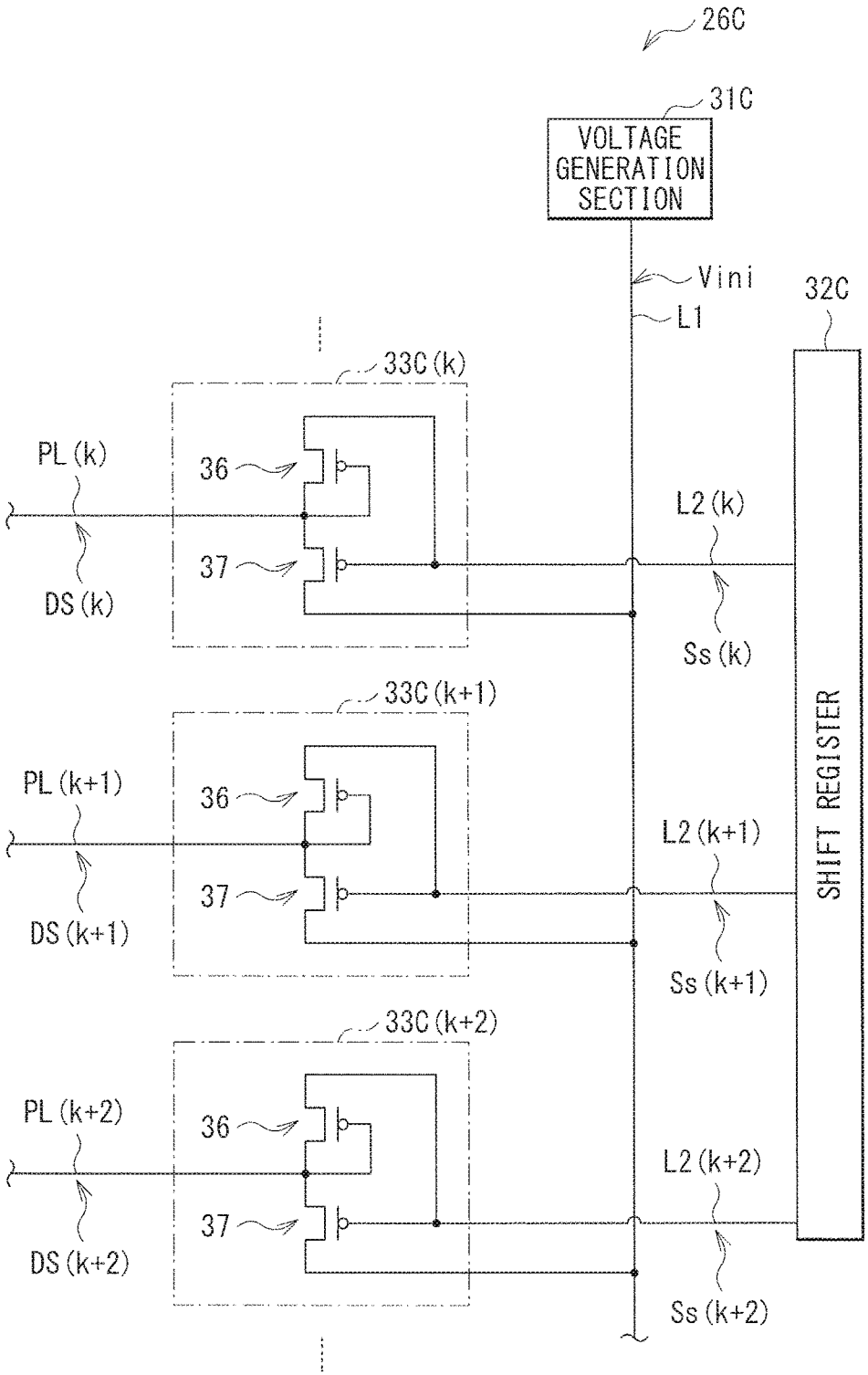

[ FIG. 13 ]
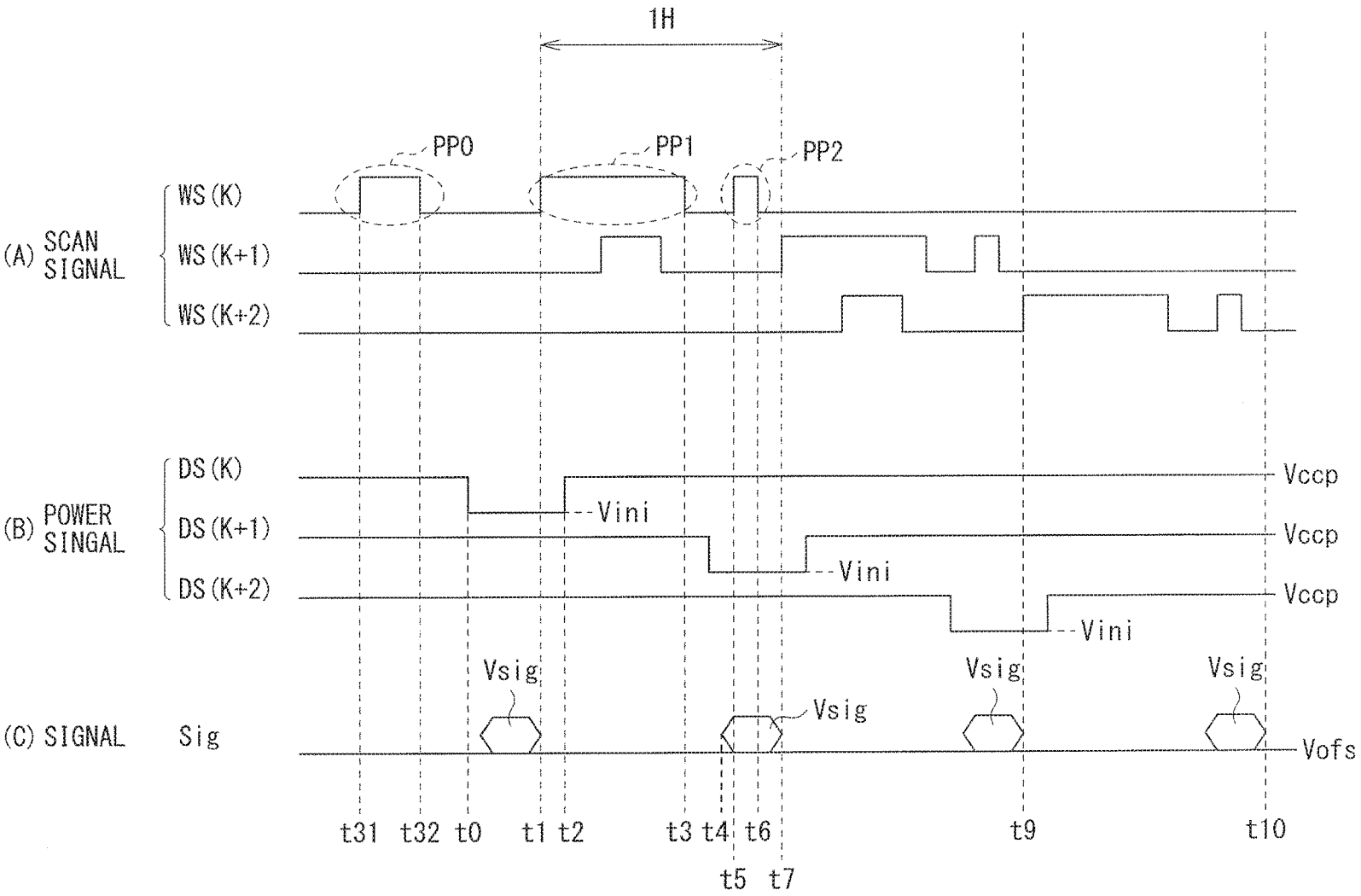

[ FIG. 14 ]
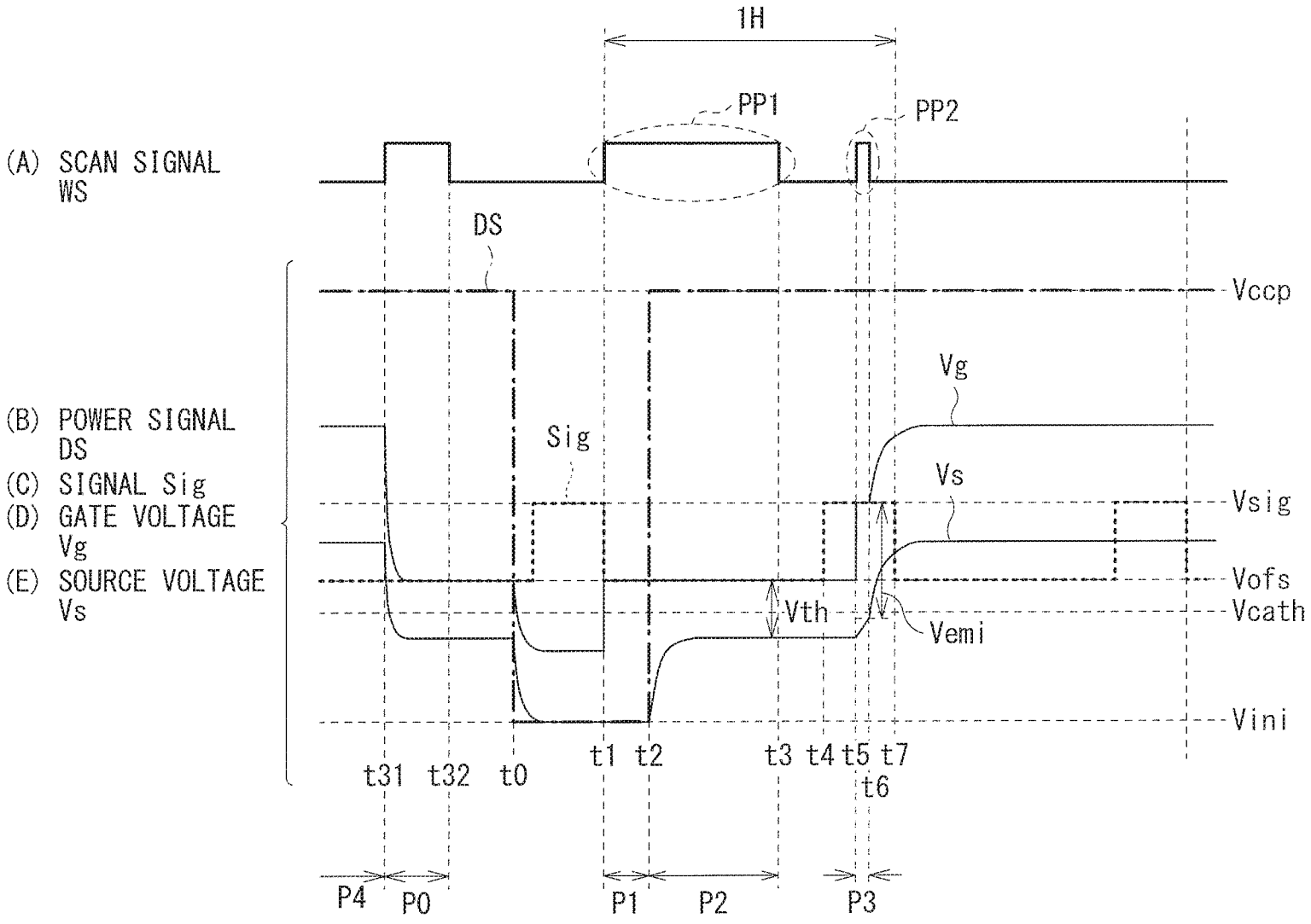

[ FIG. 15 ]
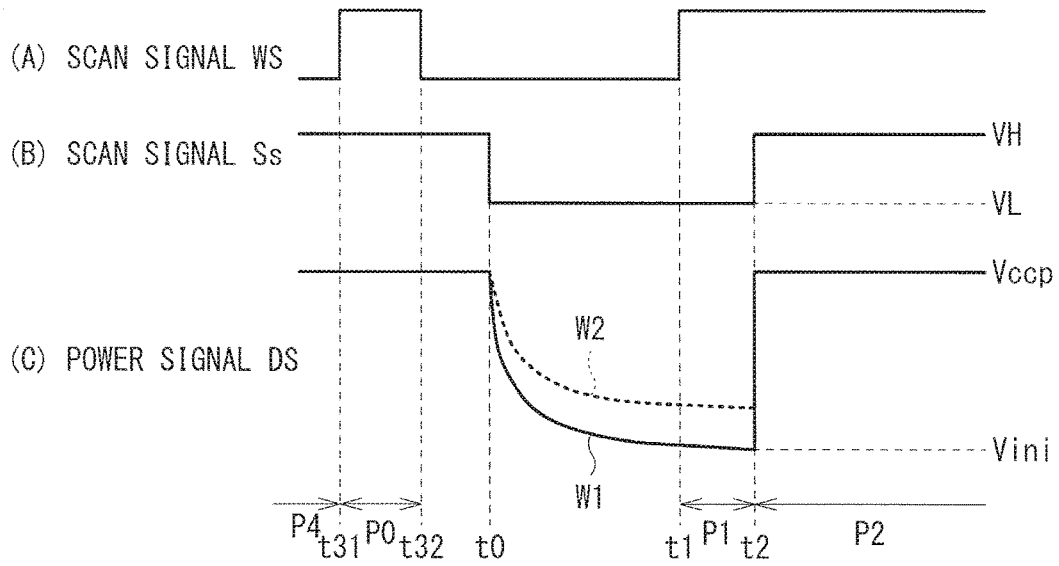

[ FIG. 16 ]
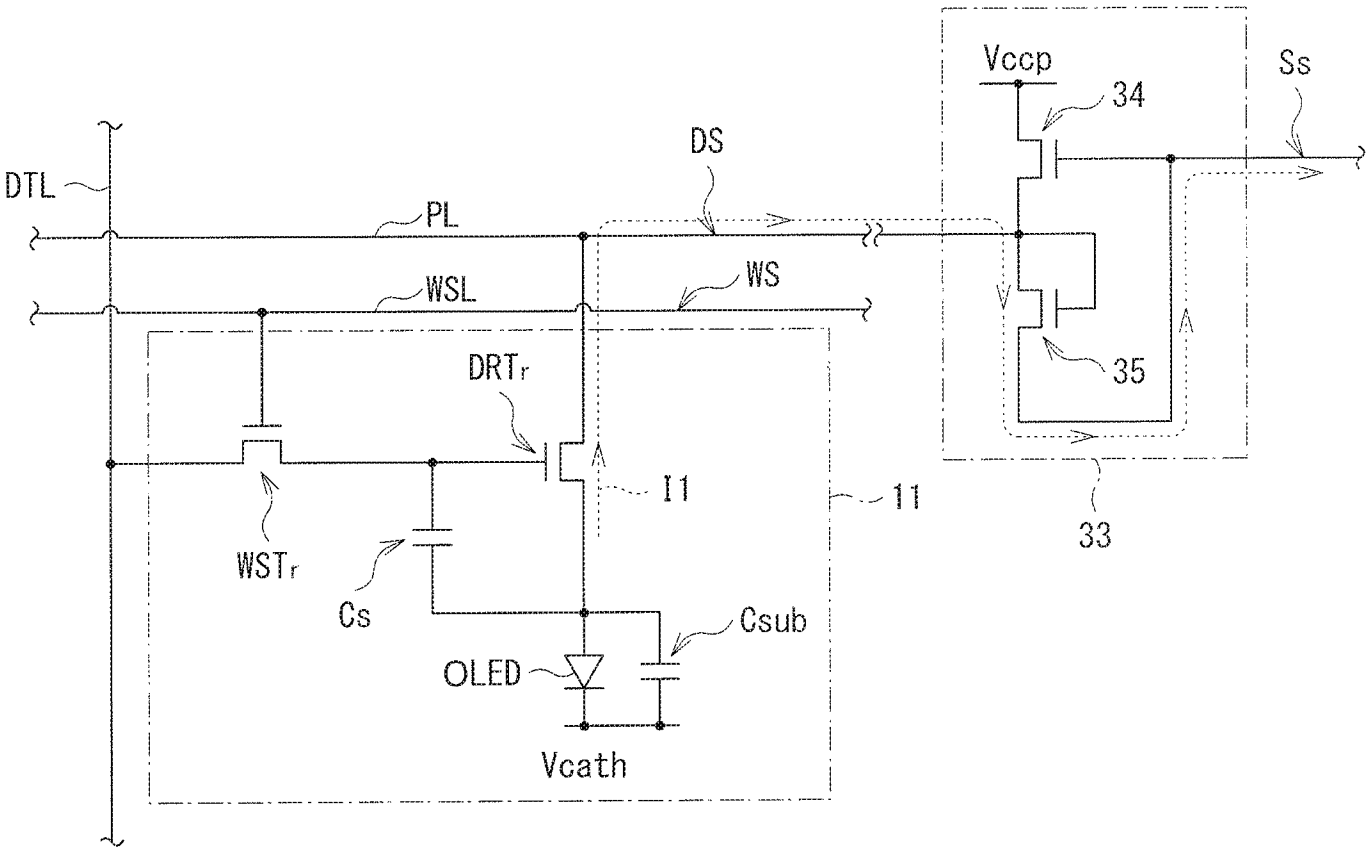

[ FIG. 17 ]
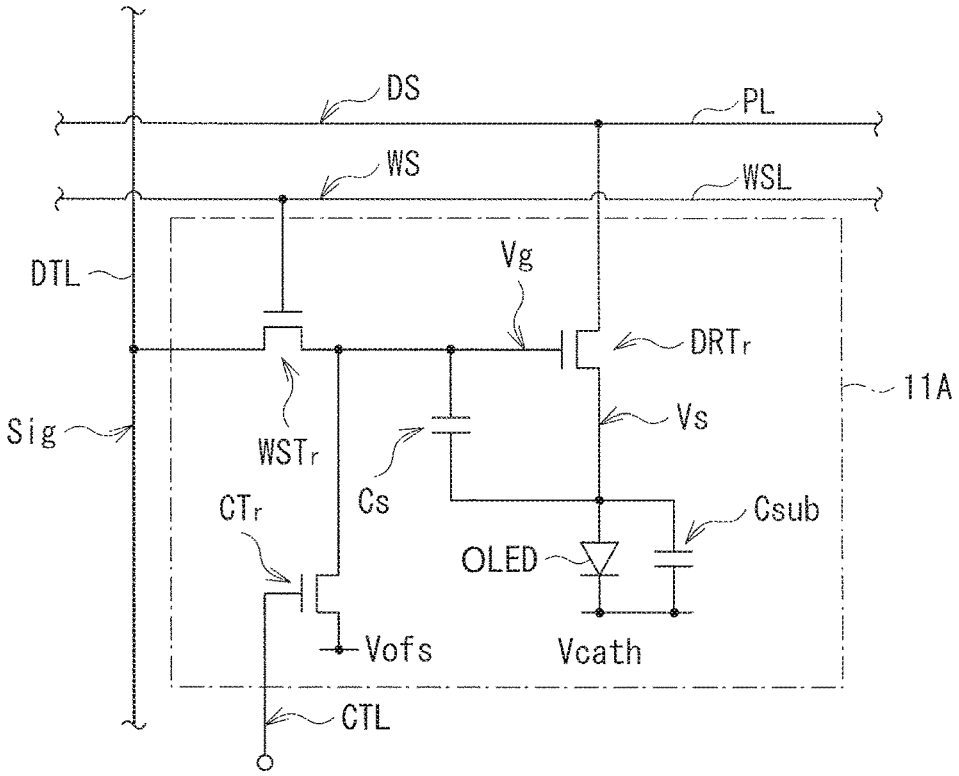
[ FIG. 18 ]
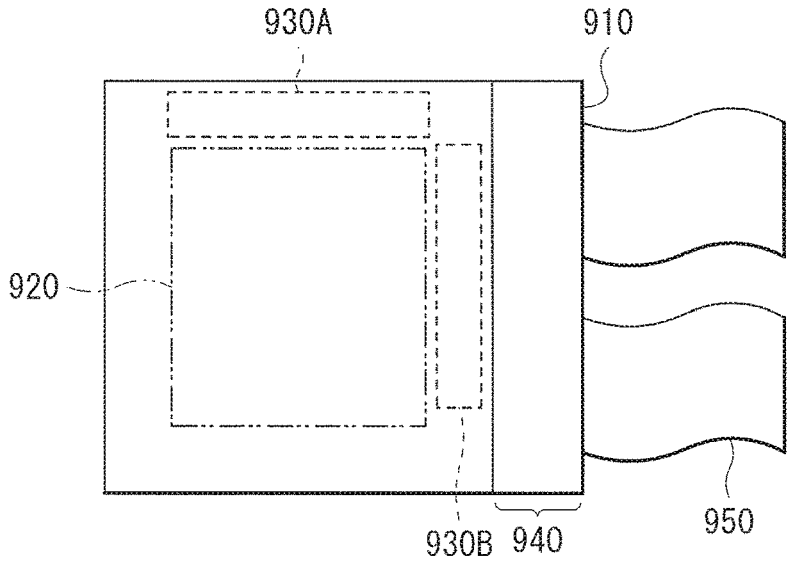

[ FIG. 19 ]
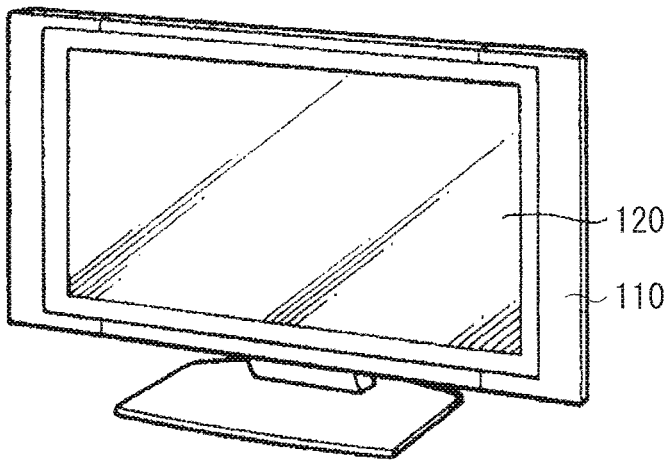

[ FIG. 20A ]
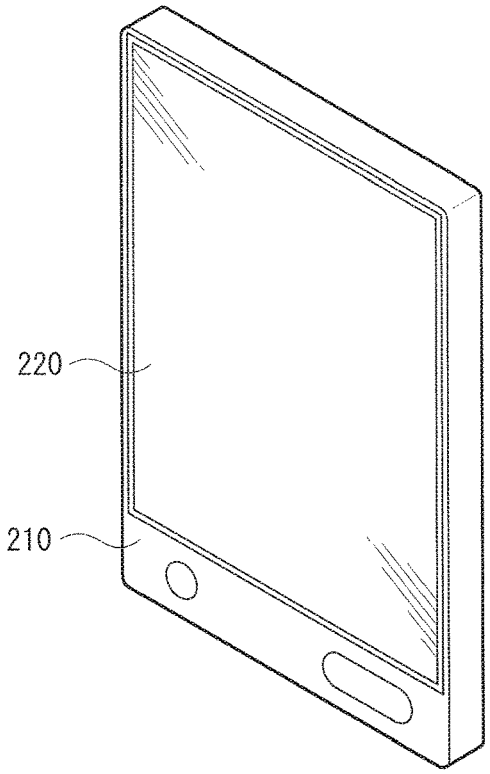
[ FIG. 20B ]
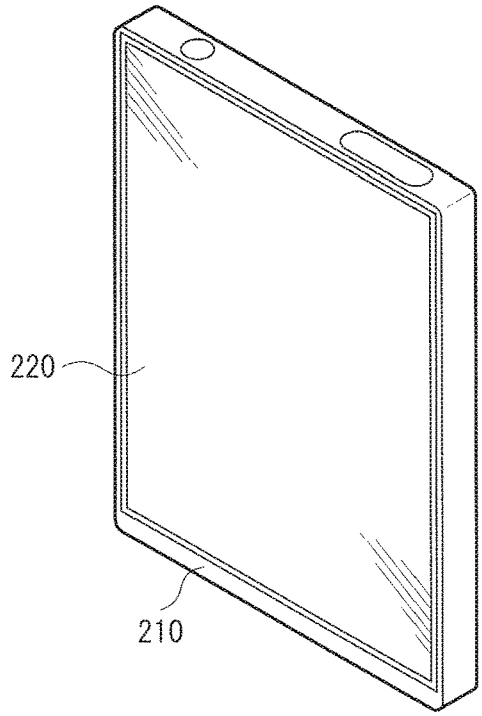

[ FIG. 21 ]
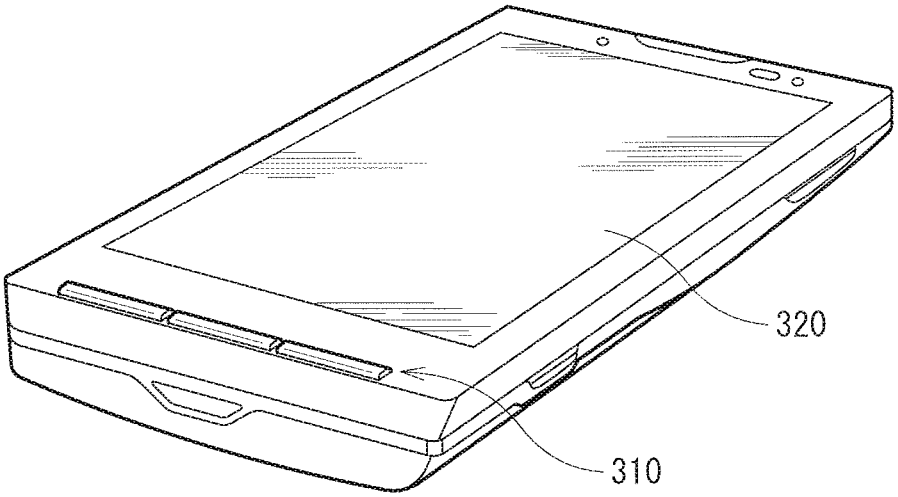
[ FIG. 22A ]
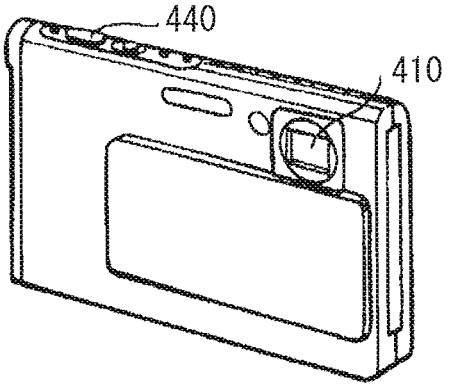
[ FIG. 22B ]
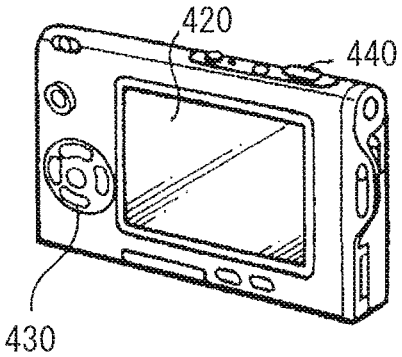

[ FIG. 23A ]
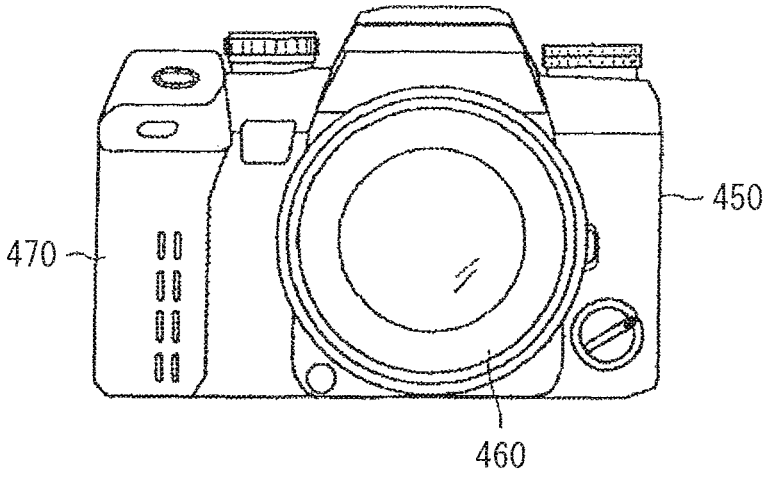
[ FIG. 23B ]
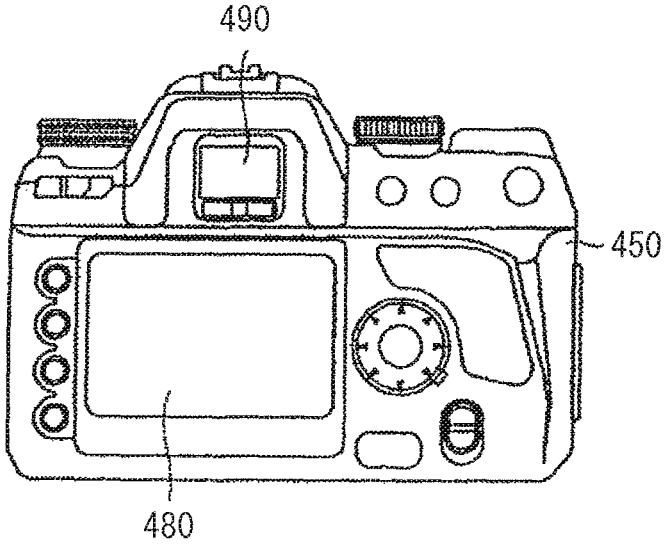

[ FIG. 24 ]
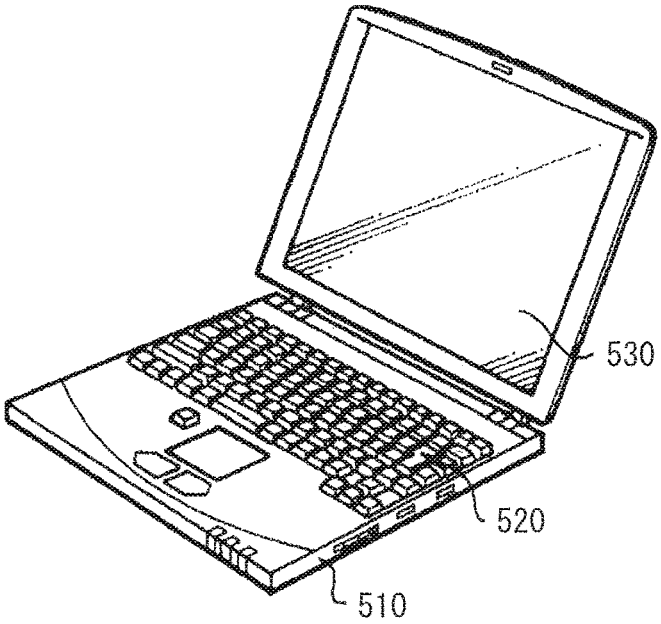
[ FIG. 25 ]
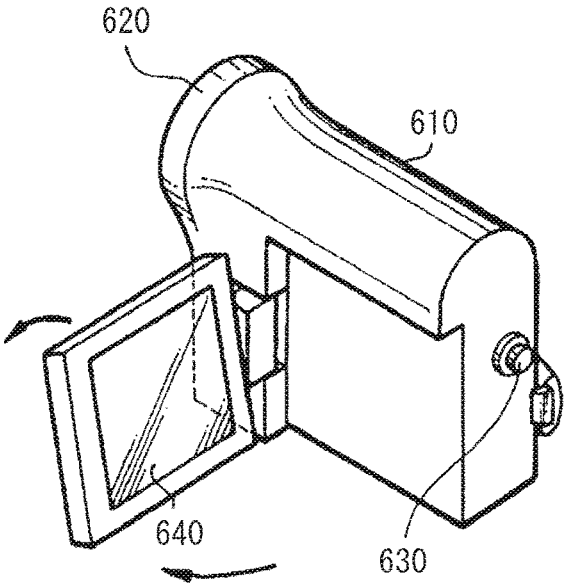

[ FIG. 26 ]
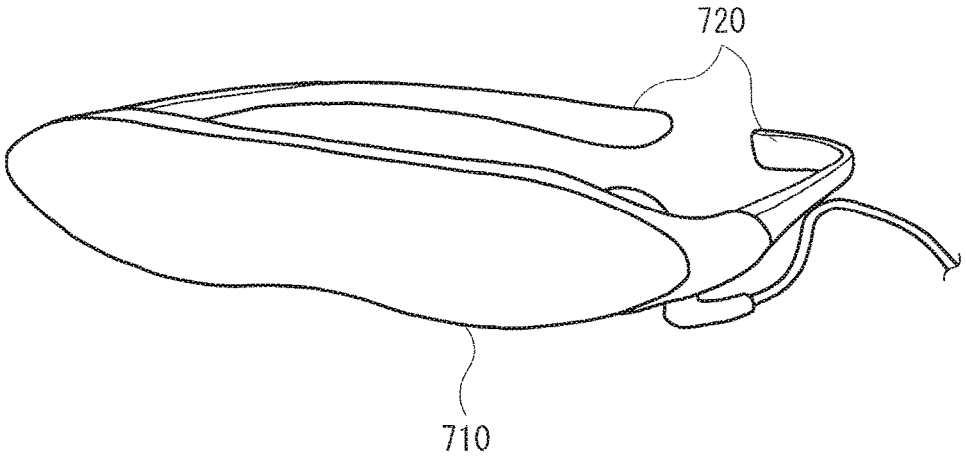
[ FIG. 27 ]
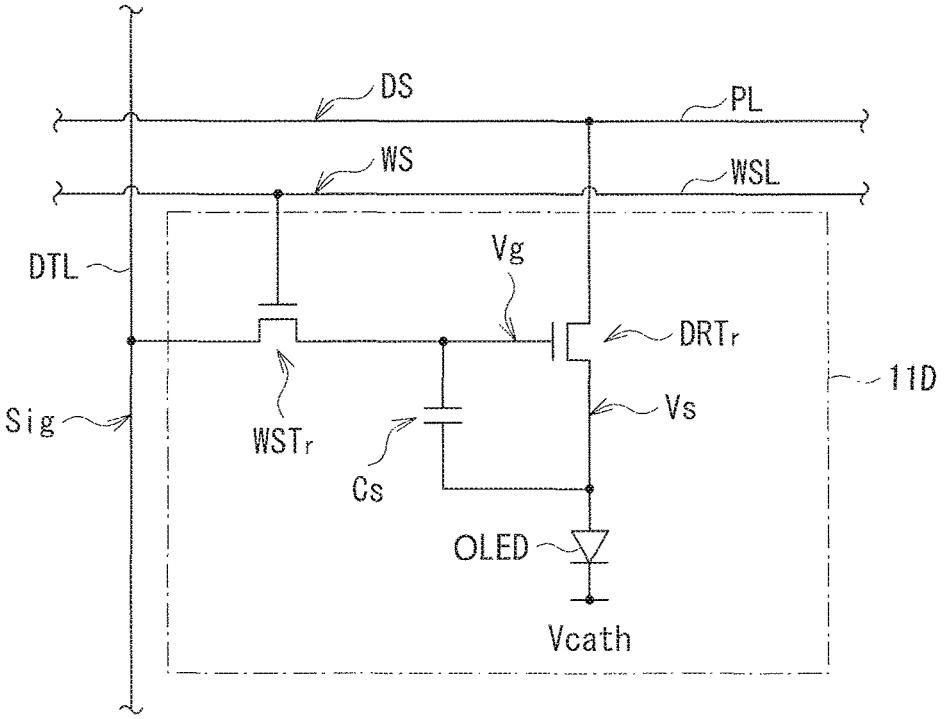

DISPLAY UNIT, DRIVE UNIT, DRIVING METHOD, AND ELECTRONIC APPARATUS

TECHNICAL FIELD

The present disclosure relates to a display unit having a current-driving display element, to a drive unit and a driving method used in such a display unit, and to an electronic apparatus including such a display unit.

BACKGROUND ART

In recent years, in a field of display units performing image display, a display unit (an organic electro luminescence (EL) display unit) using, as a light emitting element, a current-driving optical element whose light emission luminance is varied in response to a value of a flowing current, for example, an organic EL element, has been developed and commercialization thereof is progressing. Unlike a liquid crystal element or the like, the light emitting element is a self light-emitting element, and a light source (a backlight) is unnecessary. Therefore, the organic EL display unit has characteristics of high visibility of an image, low power consumption, high response speed of an element, etc., as compared with a liquid crystal display unit demanding a light source.

In the display unit, drive circuits control pixels arranged in a matrix. For example, in PTL 1, a display panel including a pixel array section and a control line driving section that is configured of a shift register and a plurality of buffer circuits is disclosed. The control line drive section supplies a control signal to each pixel through a control line. Two or more voltages (VDD/VSS) are supplied to the buffer circuits, and one of these voltages is selected and output based on a set signal and a reset signal that are supplied from outside.

CITATION LIST

Patent Literature

PTL 1: Japanese Unexamined Patent Application Publication No. 2009-223092

SUMMARY OF INVENTION

Incidentally, typically, an electronic circuit desirably has a simple configuration in terms of cost, arrangement area of circuits, flexibility of circuit layout, and the like, and a drive circuit in a display unit is also expected to have a simple configuration.

Therefore, it is desirable to provide a display unit, a drive unit, a driving method, and an electronic apparatus that are each adapted to achieve a simple circuit configuration.

A display unit according to an embodiment of the disclosure includes: a unit pixel, a switch, and a non-linear element. The switch is configured to perform ON-OFF control between a second terminal supplied with a DC signal and a third terminal connected to the unit pixel, based on a pulse signal applied to a first terminal. The non-linear element is interposed between the first terminal and the third terminal.

A drive unit according to an embodiment of the disclosure includes a switch and a non-linear element. The switch is configured to perform ON-OFF control between a second terminal supplied with a DC signal and a third terminal connected to the unit pixel, based on a pulse signal applied to a first terminal. The non-linear element is interposed between the first terminal and the third terminal.

A driving method according to an embodiment of the disclosure includes: performing ON-OFF control between a second terminal supplied with a DC signal and a third terminal connected to a unit pixel, based on a pulse signal applied to a first terminal; and performing non-linear operation between the first terminal and the third terminal.

An electronic apparatus according to an embodiment of the disclosure includes the above-described display unit, and examples of the electronic apparatus may include a television apparatus, a digital camera, a personal computer, a video camera, and a mobile terminal device such as a mobile phone.

According to the display unit, the drive unit, the driving method, and the electronic apparatus according to the respective embodiments of the disclosure, the signal is applied to the unit pixel based on the pulse signal. At this time, the switch is controlled to be turned on or turned off between the second terminal supplied with the DC signal and the third terminal connected to the unit pixel, based on the pulse signal applied to the first terminal, and non-linear operation is performed between the first terminal and the third terminal by the non-linear element.

According to the display unit, the drive unit, the driving method, and the electronic apparatus according to the respective embodiments of the disclosure, the switch that performs the ON-OFF control between the second terminal supplied with the DC signal and the third terminal connected to the unit pixel, based on the pulse signal applied to the first terminal, and the non-linear element that is interposed between the first terminal and the third terminal are provided. Therefore, it is possible to achieve a simple circuit.

BRIEF DESCRIPTION OF DRAWINGS

FIG. 1 is a block diagram illustrating a configuration example of a display unit according to an embodiment of the disclosure.

FIG. 2 is a circuit diagram illustrating a configuration example of a sub-pixel illustrated in FIG. 1.

FIG. 3 is a circuit diagram illustrating a configuration example of a power line drive section illustrated in FIG. 1.

FIG. 4 is an explanatory diagram illustrating arrangement of the power line drive section in the display unit.

FIG. 5 is a layout diagram illustrating a layout configuration example of a drive circuit and a peripheral section thereof illustrated in FIG. 3.

FIG. 6 is a timing waveform chart illustrating an operation example of a drive section according to a first embodiment.

FIG. 7 is a timing waveform chart illustrating an operation example of a sub-pixel according to the first embodiment.

FIG. 8 is a timing waveform chart illustrating an operation example of the drive circuit illustrated in FIG. 3.

FIG. 9 is a circuit diagram illustrating a configuration example of a power line drive section according to a comparative example.

FIG. 10 is a timing waveform chart illustrating an operation example of a drive circuit illustrated in FIG. 9.

FIG. 11 is a circuit diagram illustrating a configuration example of a power line drive section according to a modification of the first embodiment.

FIG. 12 is a circuit diagram illustrating a configuration example of a power line drive section according to another modification of the first embodiment.

FIG. 13 is a timing waveform chart illustrating an operation example of a drive section according to a second embodiment.

FIG. 14 is a timing waveform chart illustrating an operation example of a sub-pixel according to the second embodiment.

FIG. 15 is a timing waveform chart illustrating an operation example of a drive circuit according to the second embodiment.

FIG. 16 is an explanatory diagram illustrating an operation example of the drive circuit and the sub-pixel according to the second embodiment.

FIG. 17 is a circuit diagram illustrating a configuration example of a sub-pixel according to a modification of the second embodiment.

FIG. 18 is an explanatory diagram illustrating a configuration example of a module mounted with the display unit according to any of the embodiments.

FIG. 19 is a perspective view illustrating an appearance configuration of an application example 1 of the display unit according to any of the embodiments.

FIG. 20A is a perspective view illustrating an appearance configuration of an application example 2 of the display unit according to any of the embodiments.

FIG. 20B is a perspective view illustrating another appearance configuration of the application example 2 of the display unit according to any of the embodiments.

FIG. 21 is a perspective view illustrating an appearance configuration of an application example 3 of the display unit according to any of the embodiments.

FIG. 22A is a perspective view illustrating an appearance configuration of an application example 4 of the display unit according to any of the embodiments.

FIG. 22B is another perspective view illustrating the appearance configuration of the application example 4 of the display unit according to any of the embodiments.

FIG. 23A is a front view illustrating an appearance configuration of an application example 5 of the display unit according to any of the embodiments.

FIG. 23B is a back view illustrating the appearance configuration of the application example 5 of the display unit according to any of the embodiments.

FIG. 24 is a perspective view illustrating an appearance configuration of an application example 6 of the display unit according to any of the embodiments.

FIG. 25 is a perspective view illustrating an appearance configuration of an application example 7 of the display unit according to any of the embodiments.

FIG. 26 is a perspective view illustrating an appearance configuration of an application example 8 of the display unit according to any of the embodiments.

FIG. 27 is a circuit diagram illustrating a configuration example of a sub-pixel according to another modification.

DESCRIPTION OF EMBODIMENTS

Embodiments of the disclosure will be described in detail below with reference to drawings. Note that description thereof will be given in the following order.

1. First embodiment
2. Second embodiment
3. Application examples

1. Embodiment

Configuration Example

FIG. 1 illustrates a configuration example of a display unit according to a first embodiment. A display unit 1 is an active matrix display unit using an organic EL element. Note that a drive unit, a driving method according to respective embodiments of the disclosure are implemented by the present embodiment, and thus will be described together. The display unit 1 includes a display section 10 and a drive section 20.

The display section 10 is configured of a plurality of pixels Pix arranged in a matrix. Each of the pixels Pix includes red, green, and blue sub-pixels 11. The display section 10 includes a plurality of scan lines WSL and a plurality of power lines PL that extend in a row direction, and a plurality of data lines DTL that extend in a column direction. An end of each of the scan lines WSL, the power lines PL, and the data lines DTL is connected to the drive section 20. Each of the above-described sub-pixels 11 is disposed at an intersection of each of the scan lines WSL and each of the data lines DTL.

FIG. 2 illustrates an example of a circuit configuration of the sub-pixel 11. The sub-pixel 11 includes a write transistor WSTr, a drive transistor DRTr, an organic EL element OLED, and capacitors Cs and Csub. In other words, in this example, the sub-pixel 11 has a configuration of so-called "2Tr2C" that is configured of the two transistors (the write transistor WSTr and the drive transistor DRTr) and the two capacitors Cs and Csub.

The write transistor WSTr and the drive transistor DRTr may be each configured of, for example, an N-channel metal oxide semiconductor (MOS) thin film transistor (TFT). A gate of the write transistor WSTr is connected to the scan line WSL, a source thereof is connected to the data line DTL, and a drain thereof is connected to a gate of the drive transistor DRTr and one end of the capacitor Cs. The gate of the drive transistor DRTr is connected to the drain of the write transistor WSTr and the one end of the capacitor Cs, a drain thereof is connected to the power line PL, and a source thereof is connected to the other end of the capacitor Cs and an anode of the organic EL element OLED, and the like.

The one end of the capacitor Cs is connected to the gate of the drive transistor DRTr and the like, and the other end thereof is connected to the source of the drive transistor DRTr and the like. One end of the capacitor Csub is connected to the anode of the organic EL element OLED, and the other end thereof is connected to a cathode of the organic EL element OLED. In other words, in this example, the capacitor Csub is connected in parallel to the organic EL element OLED. The organic EL element OLED is a light emitting element emitting light of color (red, green, or blue) corresponding to each of the sub-pixels 11, and the anode thereof is connected to the source of the drive transistor DRTr and the like, and the cathode thereof is supplied with a cathode voltage Vcath by the drive section 20.

The drive section 20 drives the display section 10 based on a picture signal Sdisp and a synchronization signal Ssync that are supplied from outside. The drive section 20 includes a picture signal processing section 21, a timing generation section 22, a scan line drive section 23, a power line drive section 26, and a data line drive section 27, as illustrated in FIG. 1.

The picture signal processing section 21 performs predetermined signal processing on the picture signal Sdisp supplied from the outside to generate a picture signal Sdisp2. Examples of the predetermined signal processing may include gamma correction and overdrive correction.

The timing generation section 22 is a circuit that supplies a control signal to each of the scan line drive section 23, the power line drive section 26, and the data line drive section 27, based on the synchronization signal Ssync supplied from the outside, and controls these sections to operate in synchronization with one another.

The scan line drive section 23 sequentially applies a scan signal WS to the plurality of scan lines WSL according to the control signal supplied from the timing generation section 22, to sequentially select the sub-pixels 11 on the row basis.

The power line drive section 26 sequentially applies a power signal DS to the plurality of power lines PL according to the control signal supplied from the timing generation section 22, to control light emission operation and light extinction operation of the sub-pixels 11 on the row basis. The power signal DS transits between a voltage Vccp and a voltage Vini. As will be described later, the voltage Vini is a voltage to initialize the sub-pixels 11, and the voltage Vccp is a voltage to allow the current Ids to flow through the drive transistor DRTr to allow the organic EL element OLED to emit light.

FIG. 3 illustrates a configuration example of the power line drive section 26. The power line drive section 26 includes a voltage generation section 31, a shift register 32, and a plurality of drive circuits 33.

The voltage generation section 31 generates the voltage Vccp. The voltage generation section 31 supplies the voltage Vccp to each of the drive circuits 33 through the wiring L1.

The shift register 32 generates a plurality of scan signals Ss that are used to select a pixel line to be driven, based on the control signal (not illustrated) supplied from the timing generation section 22. Each of the scan signals Ss corresponds to each of the pixel lines in the display section 10. Specifically, for example, k-th scan signal Ss(k) corresponds to k-th pixel line. Each of the scan signals Ss is a signal transiting between a high level voltage VH and a low level voltage VL. The low level voltage VL is a voltage (Vini−Vth) lower than the voltage Vini by an amount of a threshold voltage Vth of a transistor 35 (described later) of the drive circuit 33. For example, the shift register 32 may supply the scan signal Ss(k) to k-th drive circuit 33(*k*) through k-th wiring L2(*k*).

Each of the drive circuits 33 generates the power signal DS based on the voltage Vccp supplied from the voltage generation section 31 and the scan signal Ss supplied from the shift register 32. Each of the drive circuits 33 is provided corresponding to each of the pixel lines in the display section 10. Specifically, for example, the k-th drive circuit 33(*k*) generates k-th power signal DS(k) based on the voltage Vccp and the k-th scan signal Ss(k). Then, the drive circuit 33(*k*) applies the power signal DS(k) to the power line PL(k) in the k-th pixel line.

Each of the drive circuits 33 includes transistors 34 and 35. Each of the transistors 34 and 35 may be configured of, for example, an N-channel MOSTFT similar to the write transistor WSTr and the drive transistor DRTr. In the drive circuit 33(*k*), a gate of the transistor 34 is connected to a source of the transistor 35 and the wiring L2(*k*), a drain thereof is connected to the wiring L1, and a source thereof is connected to a drain and a gate of the transistor 35 and the power line PL(k). In the drive circuit 33(*k*), a drain of the transistor 35 is connected to the gate of the transistor 35, the source of the transistor 34, and the power line PL(k), the source thereof is connected to the gate of the transistor 34 and the wiring L2(*k*). In other words, the transistor 35 is so-called diode-connected. The transistor 34 is formed to have a channel width W larger than a channel width W of the transistor 35.

With this configuration, in the drive circuit 33(*k*), when the voltage of the scan signal Ss(k) is the high level voltage VH, the transistor 34 is turned on and the transistor 35 is turned off. Accordingly, the drive circuit 33(*k*) outputs the voltage Vccp as the power signal DS(k). In addition, when the voltage of the scan signal Ss(k) is the low level voltage VL, the transistor 34 is turned off and the transistor 35 is transiently turned on. Accordingly, the drive circuit 33(*k*) outputs the voltage Vini that is higher than the low level voltage VL (=Vini−Vth) by an amount of the threshold voltage Vth of the transistor 35, as the power signal DS(k).

FIG. 4 illustrates arrangement of the power line drive section 26 in the display unit 1. In this example, the scan line drive section 23 is disposed in a bezel region on left side of a region provided with the display section 10 of the substrate 30, and the power line drive section 26 is disposed in a bezel region on right side thereof. In the region provided with the power line drive section 26, the wiring L1 is so provided as to extend in a vertical direction. Further, the shift register 32 is disposed on right side of the wiring L1, and the plurality of drive circuits 33 are disposed in a region 39 on left side of the wiring L1.

FIG. 5 illustrates a layout configuration example of the drive circuit 33 and the peripheral section thereof. In this example, the display unit 1 is manufactured with use of a manufacturing process that is adapted to form two metal layers, a lower layer metal M1 and an upper layer metal M2. The lower layer metal M1 may be formed of, for example, molybdenum Mo, and the upper layer metal M2 may be formed of, for example, aluminum Al. A sheet resistance of the upper layer metal M2 is lower than a sheet resistance of the lower layer metal M1.

The gate (a gate part GP) of each of the transistors 34 and 35 is configured of the lower layer metal M1, and the drain and the source of each of the transistors 34 and 35 are connected to the upper layer metal M2. The wiring L1 is formed of the upper layer metal M2 and is connected to the drain of the transistor 34. The wiring L2 is formed of the upper layer metal M2 in a part other than a part intersecting with the wiring L1, and is formed of the lower layer metal M1 in the part intersecting with the wiring L1. The wiring L2 is connected to the gate (the gate part GP) of the transistor 34, and is connected to the upper layer metal M2 that is connected to the source of the transistor 35, through a contact CT. The power line PL is formed of the upper layer metal M2, is connected to the source of the transistor 34 and the drain of the transistor 35, and is connected to the gate of the transistor 35 through a contact CT.

In FIG. 1, the data line drive section 27 generates a signal Sig including a pixel voltage Vsig that instructs emission luminance of each sub-pixel 11 and a voltage Vofs that is used to perform Vth correction described later, according to the picture signal Sdisp2 supplied from the picture signal processing section 21 and the control signal supplied from the timing generation section 22, and applies the signal Sig to each of the data lines DTL.

With this configuration, as will be described later, the drive section 20 performs correction (the Vth correction) to suppress influence of the element variation of the drive transistor DRTr to the image quality, on the sub-pixels 11. After that, the drive section 20 performs writing of the pixel voltage Vsig on the sub-pixels 11 and performs μ (mobility) correction different from the above-described Vth correction. Then, thereafter, the organic EL element OLED of each of the sub-pixels 11 emits light with luminance corresponding to the written pixel voltage Vsig.

Here, the sub-pixel 11 corresponds to a specific but non-limiting example of "unit pixel" in the disclosure. The capacitor Cs corresponds to a specific but non-limiting example of "first capacitor" in the disclosure. The capacitor Csub corresponds to a specific but non-limiting example of "second capacitor" in the disclosure. The organic EL element OLED corresponds to a specific but non-limiting example of "display element" in the disclosure. The transistor 34 corresponds to a specific but non-limiting example of "switch" in the disclosure. The transistor 35 corresponds to a specific but non-limiting example of "non-linear element" in the disclosure. The scan signal Ss corresponds to a specific but non-limiting example of "pulse signal" in the disclosure. The wiring L2 corresponds to a specific but non-limiting example of "first wiring" in the disclosure, and the wiring L1 corresponds to a specific but non-limiting example of "second wiring" in the disclosure. The high level voltage VH corresponds to a specific but non-limiting example of "first voltage" in the disclosure, and the low level voltage VL corresponds to a specific but non-limiting example of "second voltage" in the disclosure. The voltage Vini corresponds to a specific but non-limiting example of "third voltage" in the disclosure, and the voltage Vccp corresponds to a specific but non-limiting example of "fourth voltage" in the disclosure. The voltage Vofs corresponds to a specific but non-limiting example of "reset voltage" in the disclosure.

(Operation and Function)

Subsequently, operation and function of the display unit 1 according to the present embodiment is described.

(General Operation Outline)

First, with reference to FIG. 1, general operation outline of the display unit 1 is described. The picture signal processing section 21 performs predetermined signal processing on the picture signal Sdisp supplied from the outside to generate the picture signal Sdisp2. The timing generation section 22 supplies the control signal to each of the scan line drive section 23, the power line drive section 26, and the data line drive section 27, based on the synchronization signal Ssync supplied from the outside, to control these sections to operate in synchronization with one another. The scan line drive section 23 sequentially applies the scan signal WS to each of the plurality of scan lines WSL according to the control signal supplied from the timing generation section 22 to sequentially select the sub-pixels 11 on the row basis. The power line drive section 26 sequentially applies the power signal DS to each of the plurality of power lines PL according to the control signal supplied from the timing generation section 22, to control light emission operation and light extinction operation of the sub-pixels 11 on the row basis. The data line drive section 27 generates the signal Sig including the pixel voltage Vsig that instructs emission luminance of each of the sub-pixels 11 and the voltage Vofs that is used to perform the Vth correction, according to the picture signal Sdisp2 supplied from the picture signal processing section 21 and the control signal supplied from the timing generation section 22, and applies the signal Sig to each of the data lines DTL. The display section 10 performs display based on the scan signal WS, the power signal DS, and the signal Sig that are supplied from the drive section 20.

(Detailed Operation)

FIG. 6 is a timing chart of the operation of the drive section 20, where (A) illustrates a waveform of the scan signal WS, (B) illustrates a waveform of the power signal DS, and (C) illustrates a waveform of the signal Sig. In (A) of FIG. 6, the scan signal WS(k) indicates the scan signal WS driving the sub-pixels 11 in the k-th line. Likewise, the scan signals WS(k+1), WS(k+2), and WS(K+3) indicates the scan signals WS driving the sub-pixels 11 in (k+1)-th line, (k+2)-th line, and (k+3)-th line, respectively. The same applies to the power signal DS ((B) of FIG. 6).

The scan line drive section 23 of the drive section 20 sequentially applies the scan signal WS having two pulses PP1 and PP2 to each of the scan lines WSL ((A) of FIG. 6). At this time, the scan line drive section 23 applies the two pulses PP1 and PP2 to one scan line WSL during one horizontal period (1H). The power line drive section 26 applies the power signal DS that becomes the voltage Vini only during a predetermined period (for example, a period from timing t0 to timing t2) including start timing (for example, timing t1) of the pulse PP1 and becomes the voltage Vccp during other periods, to each of the power lines PL ((B) of FIG. 6). The data line drive section 27 applies the pixel voltage Vsig to each of the data lines DTL during a predetermined period including the pulse PP2 (for example, a period from timing t4 to timing t7), and applies the voltage Vofs to each of the data lines DTL during other periods ((C) of FIG. 6).

In this way, the drive section 20 drives the sub-pixels 11 in the k-th line during one horizontal period (for example, from timing t1 to timing t7), and drives the sub-pixels 11 in the (k+1)-th line during next horizontal period (for example, from timing t7 to timing t8). Then, drive section 20 drives all of the sub-pixels 11 of the display section 10 during one frame period.

FIG. 7 is a timing chart of the operation of the sub-pixel 11 during the period from the timing t0 to the timing t7, where (A) illustrates a waveform of the scan signal WS, (B) illustrates a waveform of the power signal DS, (C) illustrates a waveform of the signal Sig, (D) illustrates a waveform of the gate voltage Vg of the drive transistor DRTr, and (E) illustrates a waveform of the source voltage Vs of the drive transistor DRTr. In (B) to (E) of FIG. 7, each waveform is illustrated with use of the same voltage axis.

The drive section 20 performs initialization of the sub-pixels 11 (initialization period P1), performs the Vth correction to suppress influence of the element variation of the drive transistor DRTr to the image quality (Vth correction period P2), and performs writing of the pixel voltage Vsig to the sub-pixels 11 and the μ correction (writing and μ correction period P3) during one horizontal period (1H). Then, thereafter, the organic EL element OLED of each of the sub-pixels 11 emits light with luminance corresponding to the written pixel voltage Vsig (emission period P4).

Here, the initialization period P1 corresponds to a specific but non-limiting example of "first sub-period" in the disclosure, the Vth correction period P2 corresponds to a specific but non-limiting example of "second sub-period" in the disclosure.

The detail thereof is described below.

First, the power line drive section 26 varies the power signal DS from the voltage Vccp to the voltage Vini at timing t0 prior to the initialization period P1 ((B) of FIG. 7). Accordingly, the drive transistor DRTr is turned on, and the source voltage Vs of the drive transistor DRTr is set to the voltage Vini ((E) of FIG. 7).

Next, the drive section 20 initializes the sub-pixels 11 during the period from the timing t1 to the timing t2 (initialization period P1). Specifically, at the timing t1, the data line drive section 27 sets the signal Sig to the voltage Vofs ((C) of FIG. 7), and the scan line drive section 23 varies the voltage of the scan signal WS from the low level to the high level ((A) of FIG. 7). As a result, the write transistor WSTr is turned on, and the gate voltage Vg of the drive transistor DRTr is set to the voltage Vofs ((D) of FIG. 7). In this way, the gate-source voltage Vgs (=Vofs−Vini) of the drive transistor DRTr is set to a voltage larger than the threshold voltage Vth of the drive transistor DRTr, which initializes the sub-pixels 11.

Next, the drive section 20 performs the Vth correction during the period from the timing t2 to the timing t3 (Vth correction period P2). Specifically, the power line drive section 26 varies the power signal DS from the voltage Vini to the voltage Vccp at the timing t2 ((B) of FIG. 7). As a result, the drive transistor DRTr operates in a saturation region, and the current Ids flows from the drain to the source. The current Ids increases the source voltage Vs ((E) of FIG. 7). At this time, since the source voltage Vs is lower than the voltage Vcath of the cathode of the organic EL element OLED, the organic EL element OLED maintains a reverse bias state, and a current does not flow through the organic EL element OLED. The source voltage Vs increases in this way, which decreases the gate-source voltage Vgs. Therefore, the current Ids decreases. The current Ids converges toward "0" (zero) by the negative feedback operation. In other words, the gate-source voltage Vgs of the drive transistor DRTr converges to be equal to the threshold voltage Vth of the drive transistor DRTr (Vgs=Vth).

Next, the scan line drive section 23 varies the voltage of the scan signal WS from high level to low level at the timing t3 ((A) of FIG. 7). As a result, the write transistor WSTr is turned off. Then, the data line drive section 27 sets the signal Sig to the pixel voltage Vsig at the timing t4 ((C) of FIG. 7).

Then, the drive section 20 performs writing of the pixel voltage Vsig to the sub-pixels 11 and performs the μ correction during the period from timing t5 to timing t6 (writing and μ correction period P3). Specifically, the scan line drive section 23 varies the voltage of the scan signal WS from low level to high level at the timing t5 ((A) of FIG. 7). As a result, the write transistor WSTr is turned on, and the gate voltage Vg of the drive transistor DRTr increases from the voltage Vofs to the pixel voltage Vsig ((D) of FIG. 7). At this time, the gate-source voltage Vgs of the drive transistor DRTr becomes lager than the threshold voltage Vth (Vgs>Vth), and the current Ids flows from the drain to the source. Therefore, the source voltage Vs of the drive transistor DRTr increases ((E) of FIG. 7). With such negative feedback operation, influence of the element variation of the drive transistor DRTr is suppressed (μ(mobility) correction), and the gate-source voltage Vgs of the drive transistor DRTr is set to a voltage Vemi corresponding to the pixel voltage Vsig.

Then, the drive section 20 allows the sub-pixels 11 to emit light during a period after the timing t6 (emission period P4). Specifically, the scan line drive section 23 varies the voltage of the scan signal WS from high level to low level at the timing t6 ((A) of FIG. 7). As a result, the write transistor WSTr is turned off, and the gate of the drive transistor DRTr becomes floating. Accordingly, thereafter, an inter-terminal voltage of the capacitor Cs, namely, the gate-source voltage Vgs of the drive transistor DRTr is maintained. Further, the source voltage Vs of the drive transistor DRTr increases as the current Ids flows through the drive transistor DRTr ((E) of FIG. 7), and the gate voltage Vg of the drive transistor DRTr accordingly increases ((D) of FIG. 7). Then, when the source voltage Vs of the drive transistor DRTr becomes larger than a sum (Vel+Vcath) of the threshold Vel of the organic EL element OLED and the voltage Vcath by such bootstrap operation, a current flows between the anode and the cathode of the organic EL element OLED, and the organic EL element OLED emits light. In other words, the source voltage Vs increases according to element variation of the organic EL element OLED, and the organic EL element OLED emits light.

After that, in the display unit 1, after a predetermined period (one frame period) is elapsed, transition from the emission period P4 to the initialization period P1 occurs. The drive section 20 performs driving so as to repeat the series of operation.

In this way, in the display unit 1, both the Vth correction and the μ correction are performed. Therefore, it is possible to suppress degradation of image quality caused by element variation of the drive transistor DRTr. In addition, in the display unit 1, the source voltage Vs is allowed to increase according to the element variation of the organic EL element OLED during the emission period P4. Therefore, it is possible to suppress degradation of image quality caused by the element variation of the organic EL element OLED.

(Operation of Drive Circuit 33)

Next, detailed operation of the drive circuit 33 is described. The drive circuit 33 generates the power signal DS based on the voltage Vccp supplied from the voltage generation section 31 and the scan signal Ss supplied from the shift register 32.

FIG. 8 is a timing chart of operation of the drive circuit 33, where (A) illustrates a waveform of the scan signal Ss, and (B) illustrates a waveform of the power signal DS.

First, the voltage of the scan signal Ss varies from the low level voltage VL to the high level voltage VH at timing t11 ((A) of FIG. 8). As a result, the transistor 34 of the drive circuit 33 is turned on, the transistor 35 is turned off, and the voltage Vccp generated by the voltage generation section 31 is accordingly applied to the power line PL through the transistor 34. In this way, the power signal DS varies to the voltage Vccp ((B) of FIG. 8). Then, the drive circuit 33 supplies a current to each of the sub-pixels 11 connected to the power line PL during the Vth correction period P2, the writing and μ correction period P3, and the emission period P4.

Then, the voltage of the scan signal Ss varies from the high level voltage VH to the low level voltage VL (=Vini−Vth) at timing t12 ((A) of FIG. 8). As a result, the transistor 34 of the drive circuit 33 is turned off, the transistor 35 is transiently turned on, and the voltage of the power line PL accordingly decreases ((B) of FIG. 8). Then, when the voltage of the power line PL decreases to the voltage Vini, the transistor 35 is turned off. After that, initialization is performed in each of the sub-pixels 11 connected to the power line PL during the initialization period P1.

The drive circuit 33 repeats the above operation. As a result, each of the sub-pixels 11 connected to the power line PL repeats the series of operation from initialization to light emission.

As described above, in the display unit 1, the drive circuit 33 is configured using the transistor 34 that functions as a switch and the transistor 35 that functions as a non-linear element (diode). Therefore, it is possible to simplify the circuit configuration of the power line drive section 26 as will be described with comparative example.

Moreover, in the drive circuit 33, the channel width W of the transistor 34 is made larger than the channel width W of the transistor 35. Therefore, it is possible to facilitate driving of the sub-pixels 11, and to suppress the circuit area of the drive circuit 33. Specifically, the drive circuit 33 turns on the transistor 34 to supply a current to the sub-pixels 11 during the Vth correction period P2, the writing and μ correction period P3, and the emission period P4. In particular, during the emission period P4, the drive circuit 33 supplies the drive current allowing the organic EL element OLED to emit light. The drive current increases as the emission luminance of the organic EL element OLED is high. Therefore, the on resistance of the transistor 34 may be desirably sufficiently low, and the channel width W of the transistor 34 may be desirably wide. On the other hand, the drive circuit 33 applies the voltage Vini to the power line PL to set the source voltage Vs of the sub-pixels 11 to the voltage Vini, during the initialization period P1. In this case, the current transiently flows through the transistor 35 but the current does not flows through the transistor 35 constantly. Therefore, it is possible to decrease the channel width W of the transistor 35. This configuration facilitates driving of the sub-pixels 11 and makes it possible to suppress the circuit area of the drive circuit 33.

Also, as illustrated in FIG. 5, in the power line drive section 26, the wiring L1 is formed of the upper layer metal M2 that has the low sheet resistance. Therefore, it is possible to decrease the resistance value of the wiring L1, and to facilitate driving of the sub-pixels 11.

Moreover, as illustrated in FIGS. 4 and 5, in the power line drive section 26, the wiring L1 is disposed between the drive circuits 33 and the shift resister 32. Therefore, it is possible to facilitate driving of the sub-pixels 11. Specifically, for example, when the wiring L1 is disposed between the display section 10 and the drive circuits 33, the wiring L1 intersects with the power line PL. In other words, in this case, it is necessary to form the wiring L1 or the power line PL by the lower layer metal M1 having high sheet resistance, and a parasitic capacitance is unintentionally formed at the intersection. Accordingly, a rising time tr of the power signal DS applied to the power line PL is increased, and for example, a pulse having a short time width may be difficult to be generated. On the other hand, in the power line drive section 26, the wiring L1 is disposed between the drive circuits 33 and the shift register 32. Therefore, it is possible to form the wiring L1 by the upper layer metal M2 that has low sheet resistance, and to decrease the rising time tr of the power signal DS or the like. Incidentally, as illustrated in FIG. 5, in the power line drive section 26, the wiring L1 intersects with the wiring L2, and it is necessary to form the wiring L2 by the lower layer metal M1 having high sheet resistance at the intersection. However, the wiring L2 is to be connected to the transistors 34 and 35, and capacitance load is low unlike the power line PL that extends in the display panel 10. Therefore, the shift register 32 relatively easily drives the wiring L2. Consequently, it is possible to reduce possibility that the waveform of the power signal DS is blunted.

Comparative Example

Next, a power line drive section 26R according to a comparative example is described. In the present comparative example, a voltage generation section 31R generates the voltages Vccp and Vini, and a drive circuit 33R selects and outputs one of the voltages Vccp and Vini. Other configurations thereof are similar to those in the present embodiment (FIG. 1).

FIG. 9 illustrates a configuration example of the power line drive section 26R according to the comparative example. The power line drive section 26R includes the voltage generation section 31R, shift registers 32RA and 32RB, and a plurality of drive circuits 33R.

The voltage generation section 31R generates the voltage Vccp to supply the voltage Vccp to each of the drive circuits 33R thorough the wiring L1, and generates the voltage Vini to supply the voltage Vini to each of the drive circuits 33R through a wiring L3.

The shift register 32RA generates a plurality of scan signals SsA used to select a pixel line to be driven, based on the control signal (not illustrated) supplied from the timing generation section 22. For example, the shift register 32RA may supply the scan signal SsA(k) to k-th drive circuit 33R(k) through k-th wiring L2A(k). Likewise, the shift register 32RB generates a plurality of scan signals SsB used to select a pixel line to be driven, based on the control signal (not illustrated) supplied from the timing generation section 22. For example, the shift register 32RB may supply the scan signal SsB(k) to the k-th drive circuit 33R(k) through k-th wiring L2B(k).

Each of the drive circuits 33R generates the power signal DS, based on the voltages Vccp and Vini that are supplied from the voltage generation section 31R, the scan signal SsA supplied from the shift register 33RA, and the scan signal SsB supplied from the shift register 33RB. Each of the drive circuits 33R includes a transistor 35R. The transistor 35R may be configured of, for example, an N-channel MOSTFT similarly to the transistor 34 and the like. In the drive circuit 33R(k), a drain of the transistor 35R is connected to the source of the transistor 34 and the power line PL(k), a gate thereof is connected to the wiring L2B(k), and a source thereof is connected to a wiring L3.

FIG. 10 is a timing chart of operation of the drive circuit 33R, where (A) illustrates a waveform of the scan signal SsA, (B) illustrates a waveform of the scan signal SsB, and (C) illustrates a waveform of the power signal DS.

First, the voltage of the scan signal SsB varies from the high level voltage VH to the low level voltage VL at timing t21 ((B) of FIG. 10). As a result, the transistor 35R is turned off, and application of the voltage Vini to the power line PL is stopped. Then, the voltage of the scan signal SsA varies from the low level voltage VL to the high level voltage VH at timing t22 ((A) of FIG. 10). As a result, the transistor 34 is turned on, the voltage Vccp generated by the voltage generation section 31R is applied to the power line PL through the transistor 34, and the power signal DS varies to the voltage Vccp ((C) of FIG. 10).

Next, the voltage of the scan signal SsA varies from the high level voltage VH to the low level voltage VL at timing t23 ((A) of FIG. 10). As a result, the transistor 34 is turned off, and application of the voltage Vccp to the power line PL is stopped. Then, the voltage of the scan signal SsB varies from the low level voltage VL to the high level voltage VH at timing t24 ((B) of FIG. 10). As a result, the transistor 35R is turned on, and the voltage Vini generated by the voltage generation section 31R is applied to the power line PL through the transistor 35R, and the power signal DS accordingly varies to the voltage Vini ((C) of FIG. 10).

In this way, in the power line drive section 26R, the voltage generation section 31R generates the voltages Vccp and Vini, and the drive circuit 33R selects and outputs one of the voltages Vccp and Vini, based on the two scan signals SsA and SsB that are respectively generated by the shift resisters 32RA and 32RB.

In the power line drive section 26R according to the comparative example, the drive circuit 33R is configured using the two transistors 34 and 35R that functions as switches in this way. Therefore, it is necessary for the power line drive section 26R to have the two shift registers 32RA and 32RB that performs ON-OFF control of the two transistors 34 and 35R and the two wirings L1 and L3 that respectively transmit the voltages Vccp and Vini. As a result, the circuit size of the power line drive section 26R is increased, the arrangement area of the circuits and the wirings is increased, and thus flexibility of the circuit layout may be impaired. Moreover, the flexibility of product design as the entire display unit may be impaired. Specifically, in recent years, a panel having narrow bezel is desired in terms of product design. However, since the power line drive section 26R is formed in a so-called bezel region similarly to the case of FIG. 4, it may be difficult to reduce the bezel region.

On the other hand, in the power line drive section 26 according to the present embodiment, the drive circuit 33 is configured using the transistor 34 that functions as a switch and the transistor 35 that functions as a non-linear element (diode). As a result, in the power line drive section 26, simple configuration configured of one shift resister 34 and one wiring L1 is achievable, and the function equivalent to the power line drive section 26R is achievable. Accordingly, in the power line drive section 26, it is possible to decrease the circuit size, to decrease the arrangement area of the circuits and the wirings, and to enhance flexibility of the circuit layout. In addition, since a panel having narrow bezel region is achievable, which makes it possible to enhance flexibility of product design of the entire display unit.

(Effects)

As described above, in the present embodiment, the drive circuit is configured using the transistor that functions as a switch and the transistor that functions as a non-linear element (diode). Therefore, it is possible to simplify the configuration of the power line drive section. As a result, it is possible to decrease the circuit size, to decrease the arrangement area of the circuits and the wirings, and to enhance flexibility of the circuit layout, as well as to enhance flexibility of product design as the entire display unit.

Moreover, in the present embodiment, the channel width W of the transistor 34 is made lager than the channel width W of the transistor 35. This facilitates driving of the sub-pixels, and makes it possible to suppress the circuit area of the drive circuit.

Moreover, in the present embodiment, the wiring L1 is formed of the upper layer metal that has low sheet resistance. Therefore, it is possible to decrease the resistance value of the wiring L1, and to facilitate driving of the sub-pixels.

Further, in the present embodiment, the wiring L1 is disposed between the drive circuits and the shift register. Therefore, it is possible to facilitate driving of the sub-pixels.

Moreover, in the present embodiment, the display section is configured only using an NMOS transistor without using a PMOS transistor. Therefore, it is possible to manufacture the display section even by the process that is not possible to manufacture a PMOS transistor as with the oxide TFT (TOSTFT) process.

(Modification 1-1)

In the above-described embodiment, the diode-connected transistor 35 is provided in each of the drive circuits 33. However, this is not limitative, and alternatively, for example, as illustrated in FIG. 11, a diode 35B may be provided. The power line drive section 26B includes drive circuits 33B. In the drive circuit 33B(k), an anode of the diode 35B is connected to the power line PL(k), and a cathode thereof is connected to the wiring L2(*k*).

(Modification 1-2)

In the above-described embodiment, each of the transistors 34 and 35 of the drive circuit is configured of an N-channel MOSTFT. However, the transistor is not limited thereto, and for example, as illustrated in FIG. 12, each of the transistors 34 and 35 may be configured of a P-channel MOSTFT. A power line drive section 26C according to the present modification includes drive circuits 33C, a voltage generation section 31C, and a shift register 32C. Each of the drive circuit 33C includes transistors 36 and 37. Each of the transistors 36 and 37 is a P-channel MOSTFT. The transistor 36 functions as a non-linear element (diode), and the transistor 37 functions as a switch. The voltage generation section 31C generates the voltage Vini. The shift register 32C generates the plurality of scan signals Ss used to select a pixel line to be driven, based on the control signal (not illustrated) supplied from the timing generation section 22. The high level voltage VH of each of the scan signals Ss is a voltage higher than the voltage Vccp by absolute value |Vth| of the threshold voltage of the transistor 36 of the drive circuit 33C (Vccp+|Vth|).

With this configuration, in the drive circuit 33C(k), when the voltage of the scan signal Ss(k) is the low level voltage VL, the transistor 37 is turned on and the transistor 36 is turned off. As a result, the drive circuit 33C(k) outputs the voltage Vini as the power signal DS(k). Moreover, when the voltage of the scan signal Ss(k) is the high level voltage VH, the transistor 37 is turned off and the transistor 36 is transiently turned on. As a result, the drive circuit 33C(k) outputs the voltage Vccp lower than the high level voltage VH (=Vccp+|Vth|) by the absolute value |Vth| of the threshold voltage of the transistor 36, as the power signal DS(k). In this example, for example, the channel width (W) of the transistor 36 may be larger than the channel width (W) of the transistor 37.

(Modification 1-3)

In the above-described embodiment, the power line drive section 26 is configured using the drive circuits 33. However, the configuration is not limited thereto, and alternatively or in addition thereto, for example, the scan line drive section 23 may be configured using the drive circuits 33. In this case, it is possible to simplify the configuration of the scan line drive section 23.

(Modification 1-4)

In the above-described embodiment, the technology is applied to the display unit using the organic EL element. However, the application is not limited thereto, and alternatively, for example, the technology may be applied to a display unit using a liquid crystal display element. Specifically, for example, the technology may be applied to a circuit selecting pixels to which the pixel voltage is written (corresponding to the scan line drive section 23 in the above-described embodiment).

(Modification 1-5)

In the above-described embodiment, as illustrated in FIG. 7 and the like, one initialization period P1 is provided prior to the Vth correction period P2. However, this is not limitative, and alternatively, for example, a plurality of initialization periods P1 may be provided. In this case, for example, the plurality of initialization periods P1 may be provided over a plurality of horizontal periods. As a result, long initialization period P1 is ensured, which makes it possible to initialize the sub-pixels 11 more surely.

Likewise, in the above-described embodiment, as illustrated in FIG. 7 and the like, one Vth correction period P2 is provided between the initialization period P1 and the writing and μ correction period P3. However, this is not limitative, and alternatively, for example, a plurality of Vth correction periods P2 may be provided. In this case, for example, the plurality of Vth correction period P2 may be provided over a plurality of horizontal periods. As a result, long Vth correction period P2 is ensured, which makes it possible to perform the Vth correction more surely.

2. Second Embodiment

Next, a display unit 2 according to a second embodiment is described. In the present embodiment, the voltage Vofs is written to the sub-pixels 11 to perform extinction operation before initialization of the sub-pixels 11. Note that like numerals are used to designate substantially like components of the display unit 1 according to the above-described first embodiment, and the description thereof is appropriately omitted.

As illustrated in FIG. 1, the display unit 2 includes a drive section 40. The drive section 40 includes a scan line drive section 43. The scan line drive section 43 sequentially applies a scan signal WS that has three pulses PP0 to PP2, to the scan lines WSL as illustrated below.

FIG. 13 is a timing chart of operation of the drive section 40, where (A) illustrates a waveform of the scan signal WS, (B) illustrates a waveform of the power signal DS, and (C) illustrates a waveform of the signal Sig.

The scan line drive section 43 of the drive section 40 applies the pulse PP0 to one scan line WSL in one horizontal period (1H), and applies the two pulses PP1 and PP2 to the scan line WSL in next one horizontal period (1H). Specifically, the scan line drive section 23 according to the first embodiment applies the two pulses PP1 and PP2 to one scan line WSL in one horizontal period (1H), however the scan line drive section 43 according to the present embodiment further applies the pulse PP0 to the scan line WSL in one horizontal period (1H) prior to the one horizontal period (1H). Specifically, the pulse PP0 is applied during a predetermined period (for example, from timing t31 to timing t32) in a period in which the signal Sig indicates the voltage Vofs and the power signal DS relating to the pixel line to be supplied with the pulse PP0 indicates the voltage Vccp.

FIG. 14 is a timing chart of operation of the sub-pixel 11 in the display unit 2, where (A) illustrates a waveform of the scan signal WS, (B) illustrates a waveform of the power signal DS, (C) illustrates a waveform of the signal Sig, (D) illustrates a waveform of the gate voltage Vg of the drive transistor DRTr, and (E) illustrates a waveform of the source voltage Vs of the drive transistor DRTr.

First, the drive section 40 performs the extinction operation in a period from the timing t31 to the timing t32 (extinction operation period P0) prior to the initialization period P1. Specifically, at the timing t31 in the period in which the data line drive section 27 applies the voltage Vofs to the data signal line DTL, the scan line drive section 43 varies the voltage of the scan signal WS from low level to high level ((A) and (C) of FIG. 14). As a result, the write transistor WSTr is turned on, the gate voltage Vg of the drive transistor DRTr decreases from a voltage based on the pixel voltage Vsig written one frame period before, and the gate voltage Vg of the drive transistor DRTr is set to the voltage Vofs ((D) of FIG. 14). Accordingly, the source voltage Vs of the drive transistor DRTr also decreases, and the current Ids of the drive transistor DRTr becomes "0" (zero). As a result, the organic EL element OLED is turned off, and the emission period P4 is ended.

Here, the extinction operation period P0 corresponds to a specific but non-limiting example of "third sub-period" in the disclosure.

After that, at the timing t32, the scan line drive section 43 varies the voltage of the scan signal WS from high level to low level ((A) of FIG. 14). As a result, the write transistor WSTr is turned off.

Next, at the timing t0, the power line drive section 26 varies the power signal DS from the voltage Vccp to the voltage Vini, similarly to the first embodiment ((B) of FIG. 14). As a result, the drive transistor DRTr is turned on, and the source voltage VS of the drive transistor DRTr decreases to be set to the voltage Vini ((E) of FIG. 14). At this time, the gate voltage Vg of the drive transistor DRTr also decreases with the decrease of the source voltage Vs ((D) of FIG. 14).

In FIG. 14, for convenience of description, the power signal DS is illustrated to drastically vary from the voltage Vccp to the voltage Vini at the timing t0. However, actually, the power signal DS varies from the voltage Vccp to the voltage Vini with a certain time constant as illustrated below.

FIG. 15 is a timing chart of operation of the drive section 40, where (A) illustrates a waveform of the scan signal WS, (B) illustrates a waveform of the scan signal Ss, and (C) illustrates a waveform of the power signal DS. FIG. 16 illustrates operation of the drive circuit 33 and the sub-pixel 11.

The shift register 32 of the power line drive section 26 varies the voltage of the scan signal Ss from the high level voltage VH to the low level voltage VL at the timing t0 ((B) of FIG. 15). As a result, the transistor 35 is transiently turned on in each of the drive circuits 33. A current I1 accordingly flows through the shift register 32 from the drive transistors DRTr of the plurality of sub-pixels 11 connected to the power lines PL through the transistors 35 as illustrated in FIG. 16. As a result, the source voltage Vs of the drive transistor DRTr is set to the voltage Vini with a certain time constant as illustrated in (E) of FIG. 14, and the power signal DS varies from the voltage Vccp to the voltage Vini with a certain time constant as illustrated by a waveform W1 in (C) of FIG. 15. At this time, in the display unit 2, the gate voltage Vg and the source voltage Vs of the drive transistor DRTr of the sub-pixel 11 are set to predetermined voltages that are independent of the pixel voltage Vsig, immediately before the timing t0. Specifically, during a period (the extinction operation period P0) from the timing t31 to the timing t32 prior to the timing t0, when the drive section 40 performs writing of the voltage Vofs to the sub-pixel 11, the gate voltage Vg and the source voltage Vs become predetermined voltages independent of the pixel voltage Vsig that is written one frame period before, immediately before the timing t0. As a result, the power signal DS decreases from the voltage Vccp to the voltage Vini during the period from the timing t0 to the timing t2 in substantially same manner irrespective of the pixel voltage Vsig that is written one frame period before.

After that, the drive section 40 performs initialization of the sub-pixels 11 (initialization period P1), performs the Vth correction (Vth correction period P2), and performs writing of the pixel voltage Vsig to the sub-pixels 11 and performs the μ correction (writing and μ correction period P3), similarly to the drive section 20 according to the first embodiment. Then, thereafter, the organic EL elements OLED of the sub-pixels 11 emit light with luminance corresponding to the written pixel voltage Vsig (emission period P4).

In this way, in the display unit 2, the voltage Vofs is written to the sub-pixels 11 to perform the extinction operation before the initialization of the sub-pixels 11. Therefore, it is possible to decrease the power signal DS from the voltage Vccp to the voltage Vini, in the period from the timing t0 to the timing t2 in substantially same manner irrespective of the pixel voltage Vsig written one frame period before. As a result, in the display unit 2, it is possible to reduce possibility of degradation of image quality.

In other words, if the extinction operation is not performed before the initialization of the sub-pixels 11, the sub-pixels 11 perform emission operation immediately before the timing t0. At this time, the gate voltage Vg and the source voltage Vs of the drive transistor DRTr of each of the sub-pixels 11 are voltages corresponding to the pixel voltage Vsig written one frame period before, and a current corresponding to the pixel voltage Vsig flows through the organic EL element OLED. Therefore, variation of the voltage of the power signal DS after the timing t0 may be varied depending on the pixel voltage Vsig written one frame period before. In other words, for example, when the pixel voltage Vsig written one frame period before is sufficiently low, a current hardly flows through the organic EL element OLED immediately before the timing t0. Therefore, the voltage of the power signal DS varies with a certain time constant as illustrated by the waveform W1 in (C) of FIG. 15. On the other hand, for example, when the pixel voltage Vsig written one frame period before is high, a large amount of current flows through the organic EL element OLED immediately before the timing t0. Therefore, the voltage of the power signal DS may vary with a longer time constant as compared with the case where the pixel voltage Vsig is low, as illustrated by a waveform W2 in (C) of FIG. 15. In this way, since the variation of the voltage of the power signal DS varies depending on the pixel voltage Vsig written one frame period before, for example, the voltage of the power signal DS at the timing t2 may vary depending on the pixel voltage Vsig. Accordingly, the degree of the Vth correction may vary depending on the pixel voltage Vsig written one frame period before during the Vth correction period P2, which may cause degradation of image quality. Moreover, for example, when the pixel voltage Vsig written one frame period before is high and the voltage of the power signal DS is not sufficiently decreased at the timing t1, there is a possibility that the sub-pixels 11 are not sufficiently initialized during the initialization period P1, which may cause degradation of image quality.

On the other hand, in the display unit 2 according to the present embodiment, the voltage Vofs is written to the sub-pixels 11 before the initialization of the sub-pixels 11. Therefore, the power signal DS decreases from the voltage Vccp toward the voltage Vini in substantially same manner irrespective of the pixel voltage Vsig written one frame period before, during the period from the timing t0 to the timing t2. Also, since the extinction operation is performed before the initialization of the sub-pixels 11, the current hardly flows through the organic EL element OLED immediately before the timing t0. Therefore, the power signal DS is allowed to decrease from the voltage Vccp toward the voltage Vini with a short time constant. As a result, it is possible to reduce possibility of degradation of image quality in the display unit 2.

As described above, in the present embodiment, the predetermined voltage is written to the sub-pixels before initialization of the sub-pixels. Therefore, it is possible to reduce possibility of degradation of image quality.

Moreover, in the present embodiment, the extinction operation is performed before the initialization of the sub-pixels. Therefore, it is possible to reduce possibility of degradation of image quality.

Other effects are similar to those in the above-described first embodiment.

(Modification 2-1)

In the above-described embodiment, as illustrated in FIG. 14 and the like, one extinction operation period P0 is provided before the initialization period P1. However, this is not limitative, and alternatively, for example, a plurality of extinction operation periods P0 may be provided. In this case, for example, the plurality of extinction operation periods P0 may be provided over a plurality of horizontal periods. Accordingly, long extinction operation period P0 is ensured, which makes it possible to perform extinction operation more surely.

(Modification 2-2)

In the above-described embodiment, the voltage Vofs is applied to the gate of the drive transistor DRTr through the write transistor WSTr during the extinction operation period P0 prior to the initialization period P1. However, this is not limitative. For example, as with a sub-pixel 11A illustrated in FIG. 17, a control transistor CTr may be provided, and the voltage Vofs may be applied to the gate of the drive transistor DRTr through the control transistor CTr. In this example, a drain of the control transistor CTr is connected to the gate of the drive transistor DRTr, a gate thereof is supplied with the control signal CTL, and a source thereof is supplied with the voltage Vofs. Then, when the control transistor CTr is turned on, the voltage Vofs is applied to the gate of the drive transistor DRTr.

Incidentally, in this example, the voltage Vofs is applied to the gate of the drive transistor DRTr through the control transistor CTr. However, this is not limitative, and a voltage different from the voltage Vofs may be applied to the gate of the drive transistor DRTr. Moreover, in this example, the control transistor CTr is used for the extinction operation. However, this is not limitative, and the control transistor CTr may be used for one or more of the extinction operation, the initialization operation in the initialization period P1, and the Vth correction operation in the Vth correction period P2.

(Other Modification)

Any of the modifications of the above-described first embodiment may be applied to the display unit 2 according to the above-described embodiment.

3. Application Examples

Next, application examples of the display units described in the above-described embodiments are described. Any of the display units according to the above-described embodiments is applicable to display units of electronic apparatuses in various fields that display an externally input picture signal or an internally generated picture signal as an image or a picture, for example, a television apparatus, a digital camera, a notebook personal computer, a mobile terminal device such as a mobile phone, a video camera, and the like.

Any of the above-described display units may be incorporated in electronic apparatuses according to application examples described below, for example, as a module illustrated in FIG. 18. In the module, for example, a display section 920 and drive circuits 930A and 930B may be formed on a substrate 910. An external connection terminal (not illustrated) that is used to connect the drive circuit 93 with external devices is formed in a region 940 disposed on one side of the substrate 910. In this example, a flexible printed circuit (FPC) 950 that is used to input and output signals is connected to the external connection terminal. The display section 920 includes a display section 10, and each of the drive circuits 930A and 930B includes all or a part of the drive section 20 or 40.

Application Example 1

FIG. 19 illustrates an appearance of a television apparatus. The television apparatus includes a main body section 110 and a display section 120, and the display section 120 is configured of any of the display units described above.

Application Example 2

FIG. 20A illustrates an appearance of an electronic book, and FIG. 20B illustrates an appearance of other electronic book. For example, these electronic books each may include a main body section 210 and a display section 220, and the display section 220 may be configured of any of the above-described display units.

Application Example 3

FIG. 21 illustrates an appearance of a smartphone. For example, the smartphone may include a main body section 310 and a display section 320, and the display section 320 may be configured of any of the above-described display units.

Application Example 4

FIGS. 22A and 22B each illustrate an appearance of a digital camera, where FIG. 22A illustrates the appearance of the digital camera as viewed from a front side thereof (an object side), and FIG. 22B illustrates the appearance of the digital camera as viewed from a back side thereof (an image side). For example, the digital camera may include a light emitting section 410 for flash, a display section 420, a menu switch 430, and a shutter button 440, and the display section 420 may be configured of any of the above-described display units.

Application Example 5

FIGS. 23A and 23B each illustrate an appearance of a lens interchangeable type single-lens reflex digital camera, where FIG. 23A illustrates the appearance of the digital camera as viewed from a front side thereof (an object side), and FIG. 23B illustrates the appearance of the digital camera as viewed from a back side thereof (an image side). For example, the digital camera may include a main body section (a camera body) 450, an interchangeable photographing lens unit (an interchangeable lens) 460, a grip section 470, a monitor 480, and a viewfinder 490, and the viewfinder 490 may be configured of any of the above-described display units.

Application Example 6

FIG. 24 illustrates an appearance of a notebook personal computer. For example, the notebook personal computer may include a main body section 510, a keyboard 520, and a display section 530, and the display section 530 may be configured of any of the above-described display units.

Application Example 7

FIG. 25 illustrates an appearance of a video camera. For example, the video camera may include a main body section 610, a lens 620, a start-and-stop switch 630, and a display section 640, and the display section 640 may be configured of any of the above-described display units.

Application Example 8

FIG. 26 illustrates an appearance of a head mounted display. For example, the head mounted display may include an eye-glasses type display section 710 and ear hook parts 720, and the display section 710 may be configured of any of the above-described display units.

Hereinbefore, although the technology has been described with referring to the embodiments, the modifications, and the application examples to the electronic units, the technology is not limited to the embodiments and the like, and various modifications may be made. Since a panel having a narrow bezel region may be achievable by the technology, it is possible to enhance flexibility of product design of electronic apparatuses.

For example, in each of the above-described embodiments, the capacitor Csub is provided in the sub-pixel 11. However, the configuration is not limited thereto, and alternatively, for example, the capacitor Csub may be omitted as with a sub-pixel 11D illustrated in FIG. 27. Specifically, in this example, the sub-pixel 11D has a so-called "2Tr1C" configuration that is configured of two transistors (a write transistor WSTr and a drive transistor DRTr) and one capacitor Cs.

Note that the technology may be configured as follows.

(1) A display unit including:

a unit pixel;

a switch configured to perform ON-OFF control between a second terminal and a third terminal, based on a pulse signal applied to a first terminal, the second terminal being supplied with a DC signal, and the third terminal being connected to the unit pixel; and a non-linear element interposed between the first terminal and the third terminal.

(2) The display unit according to (1), wherein the non-linear element is a first transistor including a drain, a gate, and a source, the drain and the gate being connected to the third terminal, and the source being connected to the first terminal, and the switch is a second transistor having a channel width larger than a channel width of the first transistor.

(3) The display unit according to (2), wherein a conductivity type of the first transistor is same as a conductivity type of the second transistor.

(4) The display unit according to (1), wherein the non-linear element is a diode that has an anode connected to the third terminal and a cathode connected to the first terminal.

(5) The display unit according to any one of (1) to (4), further including:

a first wiring connected to the first terminal, and configured to transmit the pulse signal; and a second wiring connected to the second terminal and intersecting with the first wiring, and configured to transmit the DC signal.

(6) The display unit according to (5), wherein the second wiring has sheet resistance lower than sheet resistance of the first wiring at an intersection of the first wiring and the second wiring.

(7) The display unit according to any one of (1) to (6), wherein the pulse signal transits between a first voltage and a second voltage, the first voltage turning on the switch and turning off the non-linear element, and the second voltage turning off the switch.

(8) The display unit according to (7), wherein the unit pixel includes a display element and a drive transistor supplying a drive current to the display element, and the switch supplies the drive current to the drive transistor.

(9) The display unit according to (8), wherein the unit pixel further includes a first capacitor and a write transistor, the drive transistor includes a gate, a source connected to the display element, and a drain connected to the third terminal, the first capacitor is interposed between the gate and the source of the drive transistor, and the write transistor is turned on to apply a reset voltage to the gate of the drive transistor during a writing preparation period and to apply a pixel voltage to the gate of the drive transistor during a writing period.

10. The display unit according to (9), wherein the writing preparation period includes a first sub-period and a second sub-period that is disposed after the first sub-period, and the pulse signal is at the second voltage during the first sub-period and is at the first voltage during the second sub-period and the writing period.

(11) The display unit according to (10), wherein the non-linear element applies a third voltage corresponding to the second voltage, to the unit pixel during the first sub-period, and the switch applies a fourth voltage indicated by the DC signal, to the unit pixel during the second sub-period and the writing period.

(12) The display unit according to (11), wherein the non-linear element sets a source voltage of the drive transistor to the third voltage through the drive transistor during the first sub-period, and the switch allows a current to flow through the drive transistor to vary the source voltage of the drive transistor during the second sub-period.

(13) The display unit according to any one of (10) to (12), wherein the writing preparation period includes a third sub-period disposed before the first sub-period, the pulse signal is at the first voltage during the third sub-period, and the switch applies a fourth voltage indicated by the DC signal, to the unit pixel during the third sub-period.

(14) The display unit according to (13), wherein the drive transistor decreases an amount of the drive current to be supplied to the display element during the third sub-period.

(15) The display unit according to (8), wherein the unit pixel further includes a first capacitor and a control transistor, the drive transistor includes a gate, a source connected to the display element, and a drain connected to the third terminal, the first capacitor is interposed between the gate and the source of the drive transistor, and the control transistor is turned on to apply a reset voltage to the gate of the drive transistor during one or more of a plurality of sub-periods that are included in a writing preparation period disposed before a writing period.

(16) The display unit according to any one of (9) to (15), wherein the unit pixel further includes a second capacitor connected to the source of the drive transistor.

(17) A drive unit including:

a switch configured to perform ON-OFF control between a second terminal and a third terminal, based on a pulse signal applied to a first terminal, the second terminal being supplied with a DC signal, and the third terminal being connected to a unit pixel; and a non-linear element interposed between the first terminal and the third terminal.

(18) A driving method including:

performing ON-OFF control between a second terminal and a third terminal, based on a pulse signal applied to a first terminal, the second terminal being supplied with a DC signal, and the third terminal being connected to a unit pixel; and performing non-linear operation between the first terminal and the third terminal.

(19) An electronic apparatus provided with a display unit and a control section configured to perform operation control on the display unit, the display unit including:

a unit pixel;

a switch configured to perform ON-OFF control between a second terminal and a third terminal, based on a pulse signal applied to a first terminal, the second terminal being supplied with a DC signal, and the third terminal being connected to a unit pixel; and a non-linear element interposed between the first terminal and the third terminal.

This application is based upon and claims the benefit of priority of the Japanese Patent Application No. 2013-473, filed on Jan. 7, 2013, and the Japanese Patent Application No. 2013-239191, filed on Nov. 19, 2013, both filed with the Japan Patent Office, the entire contents of these applications are incorporated herein by reference.

It should be understood by those skilled in the art that various modifications, combinations, sub-combinations, and alterations may occur depending on design requirements and other factors insofar as they are within the scope of the appended claims or the equivalents thereof.

The invention claimed is:

1. A display comprising:

a unit pixel;

a switch configured to perform ON-OFF control between a second terminal and a third terminal, based on a pulse signal applied to a first terminal, the second terminal being supplied with a DC signal, and the third terminal being connected to the unit pixel; and a non-linear element interposed between the first terminal and the third terminal, wherein the pulse signal transits between a first voltage and a second voltage, the first voltage turning on the switch and turning off the non-linear element, and the second voltage turning off the switch, the unit pixel includes a display element and a drive transistor supplying a drive current to the display element, and the switch supplies the drive current to the drive transistor, the unit pixel further includes a first capacitor and a write transistor, the drive transistor includes a gate, a source connected to the display element, and a drain connected to the third terminal, the first capacitor is interposed between the gate and the source of the drive transistor, and the write transistor is turned on to apply a reset voltage to the gate of the drive transistor during a writing preparation period and to apply a pixel voltage to the gate of the drive transistor during a writing period.

2. The display according to claim 1, wherein the writing preparation period includes a first sub-period and a second sub-period that is disposed after the first sub-period, and the pulse signal is at the second voltage during the first sub-period and is at the first voltage during the second sub-period and the writing period.

3. The display according to claim 2, wherein the non-linear element applies a third voltage corresponding to the second voltage, to the unit pixel during the first sub-period, and the switch applies a fourth voltage indicated by the DC signal, to the unit pixel during the second sub-period and the writing period.

4. The display according to claim 3, wherein the non-linear element sets a source voltage of the drive transistor to the third voltage through the drive transistor during the first sub-period, and the switch allows a current to flow through the drive transistor to vary the source voltage of the drive transistor during the second sub-period.

5. The display according to claim 2, wherein the writing preparation period includes a third sub-period disposed before the first sub-period, the pulse signal is at the first voltage during the third sub-period, and the switch applies a fourth voltage indicated by the DC signal, to the unit pixel during the third sub-period.

6. The display according to claim 5, wherein the drive transistor decreases an amount of the drive current to be supplied to the display element during the third sub-period.

7. The display according to claim 1, wherein the unit pixel further includes a second capacitor connected to the source of the drive transistor.

8. The display according to claim 1, wherein the non-linear element is a first transistor including a drain, a gate, and a source, the drain and the gate being connected to the third terminal, and the source being connected to the first terminal, and the switch is a second transistor having a channel width larger than a channel width of the first transistor.

9. The display according to claim 8, wherein a conductivity type of the first transistor is same as a conductivity type of the second transistor.

10. The display according to claim 1, wherein the non-linear element is a diode that has an anode connected to the third terminal and a cathode connected to the first terminal.

11. The display according to claim 1, further comprising:

a first wiring connected to the first terminal, and configured to transmit the pulse signal; and a second wiring connected to the second terminal and intersecting with the first wiring, and configured to transmit the DC signal.

12. The display according to claim 11, wherein the second wiring has sheet resistance lower than sheet resistance of the first wiring at an intersection of the first wiring and the second wiring.

13. A display comprising:

a unit pixel;

a switch configured to perform ON-OFF control between a second terminal and a third terminal, based on a pulse signal applied to a first terminal, the second terminal being supplied with a DC signal, and the third terminal being connected to the unit pixel; and a non-linear element interposed between the first terminal and the third terminal, wherein the pulse signal transits between a first voltage and a second voltage, the first voltage turning on the switch and turning off the non-linear element, and the second voltage turning off the switch, the unit pixel includes a display element and a drive transistor supplying a drive current to the display element, and the switch supplies the drive current and the drive transistor, the unit pixel further includes a first capacitor and a control transistor, the drive transistor includes a gate, a source connected to the display element, and a drain connected to the third terminal, the first capacitor is interposed between the gate and the source of the drive transistor, and the control transistor is turned on to apply a reset voltage to the gate of the drive transistor during one or more of a plurality of sub-periods that are included in a writing preparation period disposed before a writing period.

14. The display according to claim 13, wherein the writing preparation period includes a first sub-period and a second sub-period that is disposed after the first sub-period, and the pulse signal is at the second voltage during the first sub-period and is at the first voltage during the second sub-period and the writing period.

15. The display according to claim 14, wherein the non-linear element applies a third voltage corresponding to the second voltage, to the unit pixel during the first sub-period, and the switch applies a fourth voltage indicated by the DC signal, to the unit pixel during the second sub-period and the writing period.

16. The display according to claim 15, wherein the non-linear element sets a source voltage of the drive transistor to the third voltage through the drive transistor during the first sub-period, and the switch allows a current to flow through the drive transistor to vary the source voltage of the drive transistor during the second sub-period.

17. The display according to claim 14, wherein the writing preparation period includes a third sub-period disposed before the first sub-period, the pulse signal is at the first voltage during the third sub-period, and the switch applies a fourth voltage indicated by the DC signal, to the unit pixel during the third sub-period.

18. The display according to claim 13, wherein the unit pixel further includes a second capacitor connected to the source of the drive transistor.

19. An electronic apparatus provided with a display and a control section configured to perform operation control on the display, the display comprising:

a unit pixel;

a switch configured to perform ON-OFF control between a second terminal and a third terminal, based on a pulse signal applied to a first terminal, the second terminal being supplied with a DC signal, and the third terminal being connected to a unit pixel; and a non-linear element interposed between the first terminal and the third terminal, wherein the pulse signal transits between a first voltage and a second voltage, the first voltage turning on the switch and turning off the non-linear element, and the second voltage turning off the switch, the unit pixel includes a display element and a drive transistor supplying a drive current to the display element, and the switch supplies the drive current to the drive transistor, the unit pixel further includes a first capacitor and a write transistor, the drive transistor includes a gate, a source connected to the display element, and a drain connected to the third terminal, the first capacitor is interposed between the gate and the source of the drive transistor, and the write transistor is turned on to apply a reset voltage to the gate of the drive transistor during a writing preparation period and to apply a pixel voltage to the gate of the drive transistor during a writing period.

* * * * *